US009443639B2

(12) United States Patent
Lee et al.

(10) Patent No.: US 9,443,639 B2
(45) Date of Patent: Sep. 13, 2016

(54) CONDUCTIVE POLYMER BLEND COMPOSITION AND MANUFACTURING METHOD THEREOF

(71) Applicant: Ajou University Industry-Academic Cooperation Foundation, Suwon-si (KR)

(72) Inventors: Suck Hyun Lee, Gwacheon-si (KR); O Pil Kwon, Suwon-si (KR); Jae Eun Um, Siheung-si (KR); Tae Ja Kim, Siheung-si (KR)

(73) Assignee: Ajou University Industry-Academic Cooperation Foundation, Suwon-si (KR)

( * ) Notice: Subject to any disclaimer, the term of this patent is extended or adjusted under 35 U.S.C. 154(b) by 67 days.

(21) Appl. No.: 14/449,612

(22) Filed: Aug. 1, 2014

(65) Prior Publication Data

US 2015/0076416 A1 Mar. 19, 2015

Related U.S. Application Data

(63) Continuation of application No. PCT/KR2013/000831, filed on Feb. 1, 2013.

(30) Foreign Application Priority Data

Feb. 1, 2012 (KR) ..... 10-2012-0010516
Jan. 31, 2013 (KR) ..... 10-2013-0011240

(51) Int. Cl.
*H01B 1/12* (2006.01)

(52) U.S. Cl.
CPC ..... *H01B 1/128* (2013.01)

(58) Field of Classification Search
CPC ..... H01B 1/128; H01B 1/124; H01B 1/125; H01B 1/127; C08G 73/026; C08G 73/0266; C08G 73/00
USPC ..... 252/500
See application file for complete search history.

(56) References Cited

U.S. PATENT DOCUMENTS 5,232,631 A 8/1993 Cao et al.
5,736,623 A * 4/1998 Angelopoulos ..... H01B 1/128 252/500
5,804,100 A * 9/1998 Angelopoulos ..... H01B 1/124 252/500
5,990,249 A * 11/1999 Angelopoulos ..... C08G 61/12 252/500
6,005,070 A * 12/1999 Angelopoulos ..... C08G 61/12 525/500
6,099,756 A * 8/2000 Angelopoulos ..... C08G 61/12 252/500
6,153,725 A * 11/2000 Angelopoulos ..... H01B 1/128 252/500
7,064,178 B2 * 6/2006 Lee ..... C08G 61/02 525/420
7,569,271 B2 8/2009 Meloni et al.
7,585,431 B1 9/2009 Afzali-Ardakani et al.
2001/0012867 A1 * 8/2001 Angelopoulos ..... C08G 61/123 524/352
2005/0269555 A1 * 12/2005 Lee ..... C08G 61/124 252/500
2009/0032774 A1 2/2009 Angelopoulos et al.
2009/0304908 A1 * 12/2009 Angelopoulos ..... H01B 1/128 427/58
2010/0041865 A1 * 2/2010 Jung ..... C08G 73/0266 528/422
2013/0164650 A1 * 6/2013 Ueda ..... H01M 8/1004 429/480
2014/0051815 A1 * 2/2014 Lee ..... C07C 309/11 525/540

FOREIGN PATENT DOCUMENTS

KR 10-0225392 B1 10/1999
KR 10-2001-0031137 A 4/2001
KR 10-2008-0018674 A 2/2006
KR 10-2006-0079402 A 7/2006

OTHER PUBLICATIONS

Sriram Viswanathan et al., "Guidelines to Creating a True Molecular Composite: Inducing Miscibility in Blends by Optimizing Intermolecular Hydrogen Bonding", Macromolecules, 2002, 35, 5049-5060.*

International Search Report of PCT/KR2013/000831, dated May 7, 2013.

* cited by examiner

*Primary Examiner* — Douglas M C Ginty

(74) *Attorney, Agent, or Firm* — Greer Burns & Crain Ltd.

(57) ABSTRACT

The embodiments described herein pertain generally to a conductive polymer blend composition including a polymer-deaggregating agent and a method for preparing the same.

18 Claims, 12 Drawing Sheets

CONDUCTIVE POLYMER BLEND COMPOSITION AND MANUFACTURING METHOD THEREOF

CROSS-REFERENCE TO RELATED APPLICATION

This application is a continuation of International Patent Application No. PCT/KR2013/000831 filed on Feb. 1, 2013, claiming priority based on Korean Patent Application No. 10-2012-0010516 filed on Feb. 1, 2012, and No. 10-2013-0011240 filed on Jan. 31, 2013 the contents of all of which are incorporated herein by reference in their entirety.

TECHNICAL FIELD

The embodiments described herein pertain generally to a conductive polymer blend composition including a polymer-deaggregating agent and a method for preparing the same.

BACKGROUND

An inherently conducting polymer (ICP) began to attract attention since the late 1970s, and the interest in the ICP reached its climax in 1990s. In 2000, the ICP was spotlighted once again as the three (3) scientists, Heeger, MacDiarmid and Shirakawa, received the Nobel award for chemistry. Over recent years, researches on the ICP have been explosively increased. An ICP composite, which is commonly called an organic metal, has been developed or utilized for various uses such as an antistatic agent, various types of organic electrodes, an embedded capacitor or resistor, OLED, or an electroactive material like a solar cell as an organic semiconductor and a corrosion inhibitor. This conductive polymer is a conjugated polymer like a polyacetylene, a polyaniline, a polypyrrole, or a polythiophene, of which a main chain contains a carbon-carbon or carbon-nitrogen double bond, and thus, which is not easily dissolved and lacks stability in the air, and further, exhibits a high brittleness property often, thereby, making the commercialization thereof difficult. In order to overcome the problems, a tremendous number of inventions have been made, and various researches regarding a substance blending approach to blend ICP and an insulting polymer have been conducted over past 30 years [U.S. Pat. No. 5,290,483, U.S. Pat. No. 5,470,505, U.S. Pat. No. 5,520,852, U.S. Pat. No. 5,882,566, U.S. Pat. No. 5,716,550, U.S. Pat. No. 6,168,732, U.S. Pat. No. 5,908,898, U.S. Pat. No. 6,752,935, U.S. Pat. No. 7,683,124, U.S. Provisional Application No. 60/435,256, US2009/0314995A1].

The insulting polymer means any polymers having electrical conductivity of $10^{-11}$ S/cm or less other than the ICP, and there has been the attempt to blend a thermoplastic or thermosetting insulating polymer and the ICP to prepare a conductive polymer blend for improvement of processability and physical properties. However, since there is no compatibility between the polymers, most blends do not contribute to the improvement of the electrical conductivity and the mechanical properties, which are essential performances, in addition to the processability. In order to improve the compatibility, methods for improving dispersity have been published as follows: (a) separately adding a deaggregating agent like an ionic or non-ionic plasticizer and a metal salt; (b) blending a polymer-type dopant obtained by modifying an insulating polymer; (c) designing, preparing and using relatively bulky functional organic acid to utilize a dopant itself as a processing aid or a surfactant; (d) providing various steps for a dispersing method to enable fine dispersion like nano-dispersion even though is no compatability; or (e) polymerizing an insulating polymer in the solution state and the ICP and simultaneously blending them in a polymerization process. However, any type of an additive having a low molecular weight cannot improve the properties of the conductive composite having strong brittleness and forming a interionic salt, and when a polymer having a high molecular weight or a polymer-type dopant [Afzali-Ardakani, U.S. Pat. No. 7,585,431] like polyamic acid is blended, the acidity is low, and an interionic salt is partially formed in the middle of a chain, so that aggregation by microphase separation occurs, and thus, a doping reaction does not effectively occur. Accordingly, the conductivity is low, the processability is deteriorated, and the uniformity of the properties is threatened. U.S. Pat. No. 7,569,271 attempted dispersion in a range of from 0.5 micron to 5 micron since gelation occurs if a size of dispersed particles is overly small, and the dispersed particles are coagulated and flocculated if the size thereof is overly large. Besides, although there have been attempts to modify the ICP itself to improve the properties of the blend, the attempted methods result in decreasing the electrical conductivity, compared to a non-modified ICP, and thus, the utilization of the ICP is restricted. Especially, in order to improve the processability, a method for introducing a structure having a long alkyl group to a conjugate base of a functional organic acid like a dodecylbenzenesulfonic acid, or a method for introducing an alkyl substituent to a benzene ring or a nitrogen atom of a polyaniline main chain has been generally used; however, if a content of the group to be introduced increases, the conductivity is significantly decreased so that the utilization of the ICP is limited to electrostatic prevention or electric gilding.

U.S. Pat. No. 5,232,631 suggested that as the doping method that changes a conjugate ion of a sulfonic acid dopant has received the most attention, the processibility is improved by improving the solubility of the conductive polymer composite in an organic solvent. For example, if a 10-camphorsulfonic acid (CSA), which is a functional organic acid, is used as a dopant of polyaniline, the EB/CSA is dissolved in the organic solvent like meta-cresol so that solution processing is possible. However, there is a problem because the polyaniline having a low molecular weight (intrinsic viscosity of 0.8-1.2 dl/g) is dissolved in 1-methyl-2-pyrrolidone (NMP), and an emeraldine base doped with CSA (EB/CSA) is dissolved in the meta-cresol but gelates when it is kept in a room temperature.

SUMMARY

In view of the foregoing, the present disclosure provides a conductive polymer blend composition including a polymer-deaggregating agent and a method for preparing the same.

However, the problems sought to be solved by the present disclosure are not limited to the above description and other problems can be clearly understood by those skilled in the art from the following description.

In one aspect of the present disclosure a method for preparing a conductive polymer blend composition includes blending a conductive polymer and a polymer-deaggregating agent to form a molecular composite.

In another aspect of the present disclosure, a conductive polymer blend composition includes a molecular composite of a conductive polymer and a polymer-deaggregating agent.

Since the ICP is not dissolved, it should be finely dispersed to improve the electrical conductivity, and in order to improve the dispersity, a plasticizer or the like for suppressing aggregation of molecules needs to be used; however, using the plasticizer a lot causes a repulsive force between composite polymers, and thereby, deteriorating the mechanical properties and further decreasing the electrical conductivity. Accordingly, in order to resolve the conventional technical problems, examples embodiments of the present disclosure can provide a multiphase polymer composition and a method for preparing the same, which first blends the ICP and a polymer-deaggregating agent (PDA) having an antiaggregating function to prepare a moldable molecular composite or a nano-dispersion of 1 μm or less, and then, uses the composite itself or blends the composite with a third component to improve the electrical conductivity and the mechanical and thermal properties. The composition can be used for various electrochemical plastic products such as electrostatic prevention, electromagnetic shield, organic electrodes, coating, fiber, or films.

Conductive plastic is divided into the ICP, which intrinsically conducts electricity, and an extrinsic conducting polymer (ECP), to which conductivity is given by inserting metallic filler into the plastic. In either case, their uses are determined to be electrostatic prevention for $10^{12}$ Ω·cm, electric coating for $10^{6}$ Ω·cm, electromagnetic shield for $10^{1}$ Ω·cm, and electrodes for $10^{-2}$ Ω·cm depending on the conductivity. With respect to semiconductors like an organic photoelectric material or LED, gas sensors, electric condensers, electric machine drivers and so on depend on the level of the conductivity.

The ICP/PDA molecular composite of example embodiments of the present disclosure is a conductive material capable of granting moldability, and the composite itself may be used as a transparent film or a coating material, fiber and a plastic material or blended with a third component to be used as a plastic conductor. Especially, since the PPC of the ICP/PPC has low viscosity and a low glass transition temperature, it can improve the moldability, and since the PPC becomes a rubber phase at a high temperature, and thus, has excellent impact resistance or the like, it can improve the mechanical properties of the ICP composite having the strong brittleness.

The PPC can also be used as a sacrificial binder as well as for biodegradation. The PPC is beneficial since if a pyrolysis temperature of the PPC is low, depolymerization occurs, and if the pyrolysis temperature is high, decomposition occurs, and thereby, leaving no residues such as ashes.

In addition, if the molecular composite is blended with a reinforcing fiber or a third polymer, the properties of the composite can be improved according to components of the reinforcing fiber or the third polymer. For example, PP can improve toughness, polyamide 12 can improve chemical resistance, PA6/PA66 can improve toughness, heat resistance and injection, PC can accomplish a superior property to carbon black, PC/ABS and PC/PBT can improve toughness and moldability, and glass fiber reinforcing polystyrene can improve stiffness and heat resistance and accomplish thermosetting polyurethane large injection. In addition, the molecular composite can be used as a conductive coating for various uses by using binders such as a methyl methacrylate polymer, an ethyl methacrylate polymer, a polyvinyl acetate, a styrene-olefin copolymer, a polyurethane, a polyvinyl formal, a polyvinyl butyral, a polycarbonate, a cellulose ester, a cellulose ether, an acrylamide polymer, a vinyl fluoride ether polymer, a vinyl pyrrolidone polymer, an ionic polyester, an ionic acrylonitrile-vinylidene chloride polymer, a methylcellulose nitrate, a gelatin, gelatin derivatives, or a polysaccharide.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
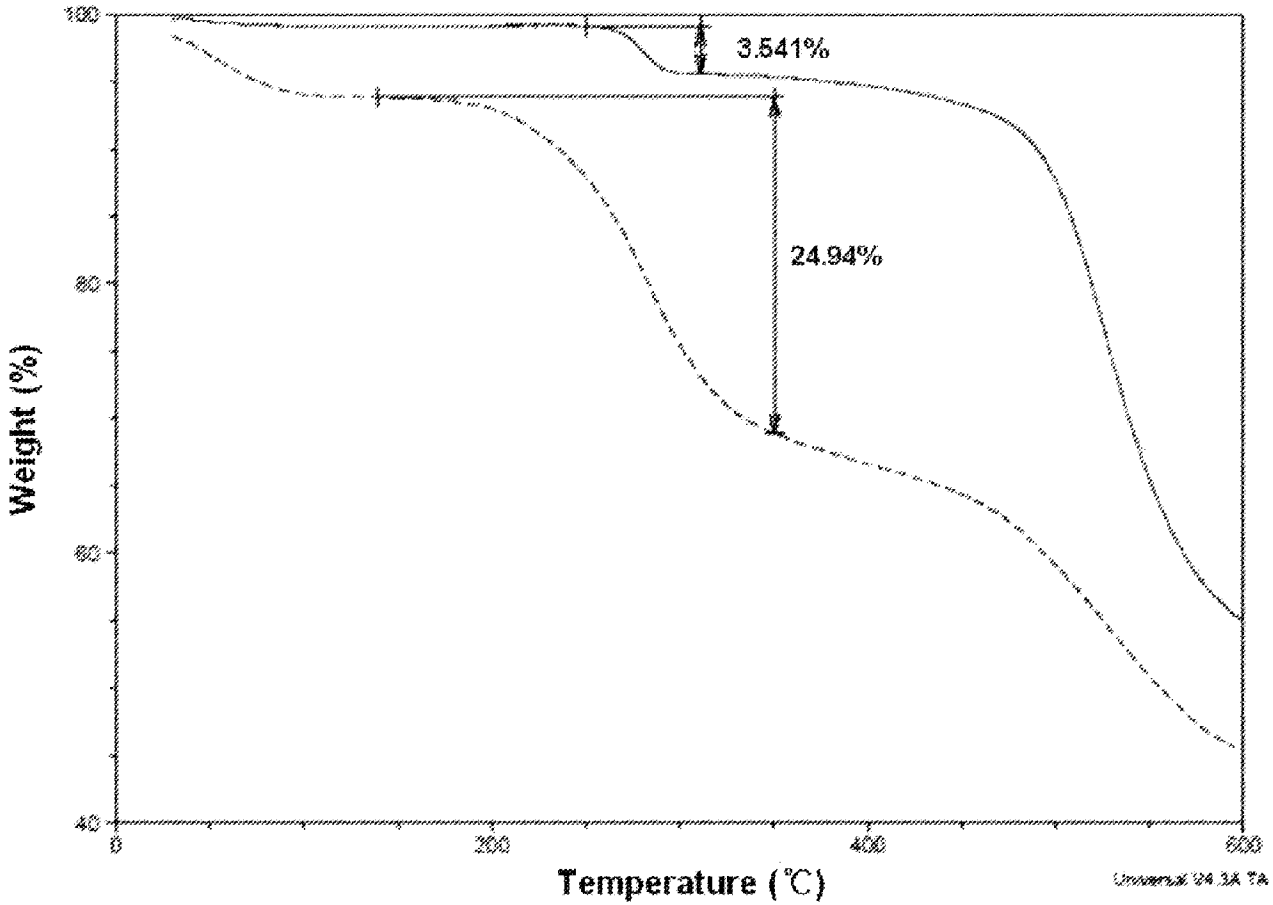
FIG. 1 shows a TGA curve of a sample containing PPC through in-situ polymerization in an example embodiment of the present disclosure.

Hereinafter, example embodiments and Examples of the present disclosure will be described in detail with reference to the accompanying drawings so that inventive concept may be readily implemented by those skilled in the art.

However, it is to be noted that the present disclosure is not limited to the example embodiments but can be realized in various other ways. In the drawings, certain parts not directly relevant to the description are omitted to enhance the clarity of the drawings, and like reference numerals denote like parts throughout the whole document of the present disclosure.

Throughout the whole document of the present disclosure, the term "on" that is used to designate a position of one element with respect to another element includes both a case that the one element is adjacent to the another element and a case that any other element exists between these two elements.

Throughout the whole document of the present disclosure, the term "comprises or includes" and/or "comprising or including" used in the document means that one or more other components, steps, operations, and/or the existence or addition of elements are not excluded in addition to the described components, steps, operations and/or elements. Throughout the whole document of the present disclosure, the terms "about or approximately" or "substantially" are intended to have meanings close to numerical values or ranges specified with an allowable error and intended to prevent accurate or absolute numerical values disclosed for understanding of the present invention from being illegally or unfairly used by any unconscionable third party. Throughout the whole document of the present disclosure, the term "step of" does not mean "step for."

Throughout the whole document of the present disclosure, the term "combinations of" included in Markush type description means mixture or combinations of one or more components, steps, operations and/or elements selected from a group consisting of components, steps, operation and/or elements described in Markush type and thereby means that the disclosure includes one or more components, steps, operations and/or elements selected from the Markush group.

Throughout the whole document of the present disclosure, the term "alkyl" includes a linear or branched alkyl group having about 1 to about 25 carbon atoms, about 1 to about 20 carbon atoms, about 1 to about 12 carbon atoms, about 1 to about 10 carbon atoms, or about 1 to about 6 carbon atoms if it is used solely or together with other terms such as "alkoxy," "arylalkyl," "alkanolamine" and "alkoxyamine," unless otherwise defined in this document. For example, the alkyl may include, methyl, ethyl, propyl, isopropyl, n-butyl, t-butyl, isobutyl, pentyl, hexyl, isohexyl, heptyl, 4,4-dimethylpentyl, octyl, 2,2,4-trimethylpentyl, nonyl, decyl, undecyl, dodecyl, isomers thereof and so on, but the present disclosure may not be limited thereto.

A first aspect of the present disclosure provides a method for preparing a conductive polymer blend composition, which includes blending a conductive polymer and a polymer-deaggregating agent (PDA) to form a molecular composite.

In an example embodiment of the present disclosure, the polymer-deaggregating agent may include at least one member selected from the group consisting of a polyalkylenecarbonate polymer, a copolymer thereof, or derivatives thereof, but may not be limited thereto. The polymer-deaggregating agent may be used as a sacrificial binder, but may not be limited thereto. The polymer-deaggregating agent may further include at least one member selected from the group consisting of a polylactide, a polyvinylalcohol, a polycarprolactone, a polycarbonate, a polymethylmethacrylate, a polyacrylic acid, a polyhydroxybutyrate, a polyethyleneoxide, a polyvinylpyrrolidinone, cellulose derivatives, a thermoplastic starch, a lignin, and combinations thereof, but may not be limited thereto.

In an example embodiment of the present disclosure, in order to improve electrical conductivity, mechanical and thermal properties and others, blending a third component with the molecular composite may be further included, but the present disclosure may not be limited thereto. The third component may include a member selected from the group consisting of a polymer, a polymer nanofiber, a glass fiber, a carbon black, a carbon nanotube, a graphite, a graphene, and combinations thereof, but may not be limited thereto. In an example embodiment of the present disclosure, the blending may include solution blending or melt blending, but may not be limited thereto.

For example, the method for preparing a conductive polymer blend composition in of the present disclosure consists of a two-step process, which is totally different from conventional preparing methods.

The first step blends an insoluble and infusible conductive polymer and a polymer-deaggregating agent (PDA), which is easily blended at a molecular or nanolayer level, to prepare a molecular or nanolayer level of a blend composite (hereinafter, referred-to as a "molecular composite"). While the PDA is a polymer having a high molecular weight, it is a material, which has a low melting point and is easily dissolved and blended with the ICP to function as a solvent/plasticizer. The present disclosure used, as the PDA, polyalkylenecarbonate and its derivatives (PAC), which have a low glass transition or melting temperature of 60° C. or less and can be clearly eliminated when it is thermally decomposed at a high temperature. The molecular composite PAC/ICP blend itself may be used as a high conductive resin or blended with various reinforcing fibers such as a third thermoplastic and thermosetting polymer binder, a glass fiber, a graphite or a carbon nanotube as a type of a conductive ICP/PDA master batch having excellent liquidity and processability to prepare a conductive composite.

The process for blending the PDA and the ICP may be accomplished in various ways. First, the blend may be prepared by dissolving the PDA in a reaction medium during polymerization process of the ICP and polymerizing the ICP. Or, the ICP may be first polymerized, and then, de-doped to prepare a processable ICP in a semiconductor base form, and thereafter, the ICP may be subject to solution or melt blending with the PDA. In this case, the ICP doping reaction may be implemented at the same time as the blending with the PDA, or the doping may be separately implemented after the PDA is blended.

For the second step, the conductive polymer molecular composite is prepared in a processsable form having significantly high conductivity of 100 S/cm or more and excellent moldability when the content of the PDA increases, and thus, in order to reinforce the stiffness, the heat resistance, the shock resistance and others, the molecular composite may be solution- or melt-blended again with a third polymer to prepare a final composition. The multiphase composition may be prepared in various forms such as a film, a fiber and a plastic injection according to use and the range of the conductivity can be variously adjusted.

In an example embodiment of the present disclosure, the conductive polymer may be an inherently conducting polymer (ICP). For example, the ICP may include a member selected from the group consisting of a polyparaphenylene, a polyparaphenylenevinylene, a polyaniline, a polyazine, a polythiophene, a poly-p-phenylene sulfide, a polyfurane, a polypyrrole, a polyselenophene, a polyacetylene, and combinations thereof, and preferably, may include a polyaniline, but may not be limited thereto.

In an example embodiment of the present disclosure, the polyanilne is an organic polymer having an alternating ring heteroatom backbone structure; especially, if a polyalkylenecarbonate is used as the polymer-deaggregating agent, the polyaniline may be modified in the manner that various substituents are introduced into a benzene ring or a nitrogen atom included in the polyaniline; and the polyaniline may be classified into a partial oxidation type (y=0.5) of an emeraldine base (EB), a complete reduction type (y=1.0) of a Leuco-emeraldine base (LB), and a complete oxidation type (y=0.0) of a pernigraniline base (PB) according to the oxidation state as shown in the chemical formula below:

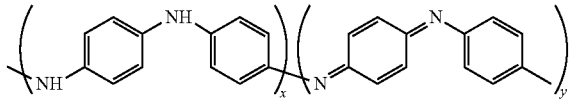

In the above chemical structure of the polyaniline, in case of x=0, the pernigraniline base (PB) is obtained; in case of y=0, the leucoemeraldine base (LB) is obtained; and in case of x=y=0.5, the emeraldine base is obtained.

For example, if the polyaniline is modified by a substituent, the aniline derivative may be substituted with a group selected from the group consisting of an alkyl group; an alkenyl group; an alkoxy group; an alkoxyalkyl group; a thioalkyl group; cyano group; a halogen group such as fluorine, chlorine, bromine and iodine; an alkoxyaryl group; an alkoxycarbonyl group; an aryl group; an oxyaryl group; an aryloxy group; an alkylaryl group; an arylalkyl group; and combinations thereof to the benzene ring, but may not be limited thereto.

In an example embodiment of the present disclosure, an aniline derivative and a polyaniline copolymer, which is a copolymer of aniline, are more preferable to form the PDA and the molecular composite. This is because the polyaniline copolymer reduces an aggregation force of molecules to induce the PDA and a molecular-level dispersion or nanodispersion having a small particle size. Accordingly, in the polyaniline copolymer, it is more preferable to connect the polymer main chain to an ortho- or meta-position to introduce bending, or induce oxygen bond to make the chain flexible, rather than simply inducing the polymer main chain in the straight line, and for example, the polyaniline may include a copolymer polyaniline including o- or m-substituted aniline, which contains o-toluidine, m-toluidine, 2-phenoxyaniline, 3-phenoxyaniline, o-ethylaniline, m-ethylaniline, o-ethoxyaniline, m-butylaniline, m-hexylaniline, m-octylaniline, 2,3-dimethylaniline, 2,5-dimethylaniline, 2,5-dimethoxyaniline, o-cyanoaniline, 2,5-dichloroaniline, 2-bromoaniline or 5-chloro-2-methoxyaniline; and 4-phenoxyaniline, 2-aminodiphenyl ether, 1,4-bis(4-aminophenoxy)benzene, 1,3-bis(4-aminophenoxy)benzene, 2,6-dichloronaphthalene, 4-methylcatechol, hydroxyquinone, or a phenol group in the polymer main chain, but may not be limited thereto. The aniline derivative may be used alone or polymerized with aniline and its blend monomer. In this case, the copolymerizing method may adopt various measures such as alternating, random, block, branches, a star shape or a comb shape, and the comonomer content may vary from about 0.05 mol % to about 99.95 mol %.

In an example embodiment of the present disclosure, the conductive polymer may be doped or de-doped by an electrical method or an acid-base reaction, but may not be limited thereto. Especially, since the polyaniline can adjust the conductivity by using the acid-base reaction, the polyaniline is widely used. A pKa values of the two (2) nitrogen atom groups (—$NH^{2+}$—) and (—$NH^{+}$=) included in the backbone of the polyaniline are 2.5 and 5.5, respectively, and accordingly, strong acid having pKa<2.5 or less can give protons to the two groups to enable doping. In case of the latter imine nitrogen atom, proton addition can be completely or partially accomplished by a protonic acid aqueous solution, and in this case, the imine nitrogen atom becomes emeraldine salts (ES) capable of adjusting the doping level, and simultaneously, the conductivity in both the powder and film forms rapidly increases from $10^{-8}$ S/cm to 1~1000 S/cm. In addition to the electrical conductivity, the processability and the heat-resistance environmental-resistance stability are also greatly affected according to the types of the dopant acid.

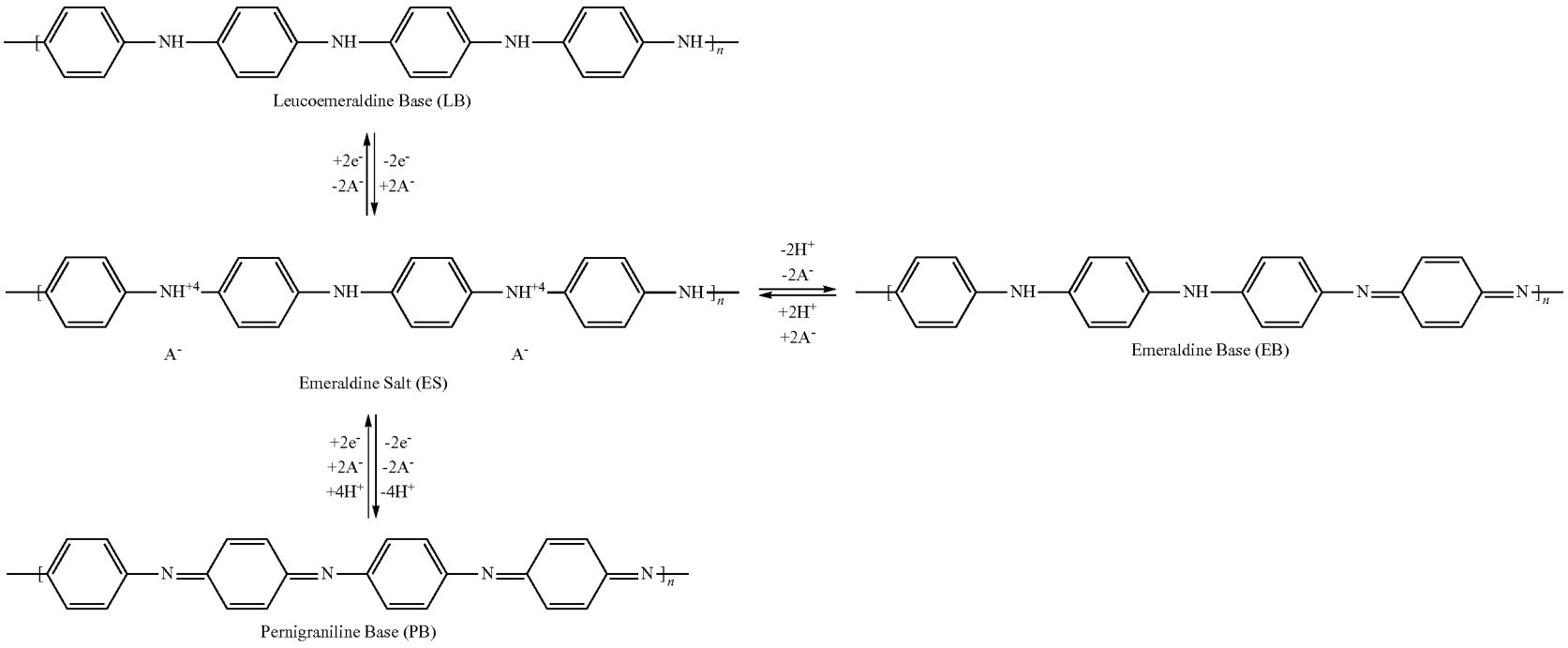
Leucoemeraldine Base (LB)
+2e⁻
-2A⁻
-2e⁻
+2A⁻
Emeraldine Salt (ES)
-2H⁺
-2A⁻
+2H⁺
+2A⁻
Emeraldine Base (EB)
+2e⁻
+2A⁻
+4H⁺
-2e⁻
-2A⁻
-4H⁺
Pernigraniline Base (PB)

In an example embodiment of the present disclosure, the protonic acid used as a dopant granting the conductivity in the above-described doping may include hydrochloric acid, sulfuric acid, nitric acid, borohydrofluoric acid, perchloric acid, amidosulfuric acid, organic acid, benzene sulfonic acid, p-toluenesulfonic acid, m-nitrobenzoic acid, trichloroacetic acid, acetic acid, propionic acid, hexanesulfonic acid, octanesulfonic acid, 4-dodecylbenzenesulfonic acid, 10-camphorsulfonic acid, ethylbenzenesulfonic acid, p-toluenesulfonic acid, o-anisidine-5-sulfonic acid, p-chlorobenzene sulfonic acid, hydroxybenzenesulfonic acid, trichlorobenzenesulfonic acid, 2-hydroxy-4-methoxybenzophenonsulfonic acid, 4-nitrotoluene-2-sulfonic acid, dinonylnaphthalenesulfonic acid, 4-morpholineethanesulfonic acid, methanesulfonic acid, ethanesulfonic acid, trifluoromethanesulfonic acid, $C_8F_{17}$-sulfonic acid, 3-hydroxypropanesulfonic acid, dioctylsulfosuccinate, 3-pyridinesulfonic acid, 2-acrylamido-2-methyl-1-propanesulfonic acid (AMPSA), or p-polystyrenesulfonic acid, but the present disclosure may not be limited thereto.

Or, for example, a polymeric acid such as a polystyrenesulfonic acid, a polyhydroxystyrenesulfonic acid, a polyvinylsulfonic acid, a polyamic acid, a polyacrylic acid, a cellulose sulfonic acid, a polyphosphoric acid, and a poly (2-acrylamido-2-methyl-1-propanesulfonic acid (PAMPSA) may be used, but may not be limited thereto. The acid may be used alone or in a mixture form of two (2) or more acids. In an example embodiment of the present disclosure, a weight-average molecular weight of the polyaniline is not specifically limited, but is considered preferable if the high conductivity of 10,000 or more can be obtained. In addition, even if a conductive polymer blend is prepared by using relatively bulky organic acid like dodecylbenzensulfonic acid (DBSA), 2-acrylamido-2-methyl-1-propanesulfonic acid (AMPSA), or camposulfonic acid (CSA), there still remains the problem of the environmental resistance or the heat resistance. Especially, in case of a polyaniline product in a thin film form, reduction of the conductivity caused by loss of the dopant in the air is a matter of importance.

A second aspect of the present disclosure provides a conductive polymer blend composition including a molecular composite of a conductive polymer and a polymer-deaggregating agent.

In an example embodiment of the present disclosure, the polymer-deaggregating agent may include a polyalkylenecarbonate polymer, a copolymer thereof, or derivatives thereof, but may not be limited thereto. For example, the polymer-deaggregating agent may be used as a sacrificial binder, but may not be limited thereto.

The polymer-deaggregating agent may further include an auxiliary polymer, and for example, may further include a polar polymer as the auxiliary polymer, but may not be limited thereto. For example, the auxiliary polymer may include a member selected from the group consisting of a polylactide, a polyvinylalcohol, a polycarprolactone, a polycarbonate, a polymethylmethacrylate, a polyacrylic acid, a polyhydroxybutyrate, a polyethyleneoxide, a polyvinylpyrrolidinone, cellulose derivatives, a thermoplastic starch, a lignin, and combinations thereof, but may not be limited thereto.

In an example embodiment of the present disclosure, the molecular composite may further include a member selected from the group consisting of a polymer, a polymer nanofiber, a glass fiber, a carbon black, a carbon nanotube, a graphite, a graphene, and combinations thereof, but may not be limited thereto.

In an example embodiment of the present disclosure, the conductive polymer blend composition may be prepared by the method of the first aspect, but may not be limited thereto.

In an example embodiment of the present disclosure, a weight ratio of the conductive polymer to the polymer-deaggregating agent may be from about 1:100 to about 100:1, but may not be limited thereto.

In an example embodiment of the present disclosure, the conductive polymer may include an inherently conducting polymer (ICP), but may not be limited thereto. For example, the conductive polymer may include a member selected from the group consisting of a polyparaphenylene, a polyparaphenylenevinylene, a polyaniline, a polyazine, a polythiophene, a poly-p-phenylene sulfide, a polyfurane, a polypyrrole, a polyselenophene, a polyacetylene, and combinations thereof, and preferably, may include a polyaniline, but may not limited thereto. If a polyalkylenecarbonate is used as the polymer-deaggregating agent, the polyaniline may be substituted with a group selected from the group consisting of an alkyl group; an alkenyl group; an alkoxy group; an alkoxyalkyl group; a thioalkyl group; a cyanoalkyl group; cyano group; a halogen group such as fluorine, chlorine, bromine and iodine; an alkoxyaryl group; an alkoxycarbonyl group; an aryl group; an aryloxy group; an alkylaryl group; an arylalkyl group; and combinations thereof to the aniline benzene ring, but may not be limited thereto.

In an example embodiment of the present disclosure, the conductive polymer might have been doped or de-doped, but may not be limited thereto. The doping may be accomplished by protonic acid including hydrochloric acid, sulfuric acid, nitric acid, borohydrofluoric acid, perchloric acid, amidosulfuric acid, organic acid, benzene sulfonic acid, p-toluenesulfonic acid, m-nitrobenzoic acid, trichloroacetic acid, acetic acid, propionic acid, hexanesulfonic acid, octanesulfonic acid, 4-dodecylbenzene sulfonic acid, 10-camphorsulfonic acid, ethylbenzenesulfonic acid, p-toluenesulfonic acid, o-anisidine-5-sulfonic acid, p-chlorobenzenesulfonic acid, hydroxybenzenesulfonic acid, trichlorobenzenesulfonic acid, 2-hydroxy-4-methoxybenzophenonesulfonic acid, 4-nitrotoluene-2-sulfonic acid, dinonylnaphthalenesulfonic acid, 4-morpholineethanesulfonic acid, methanesulfonic acid, ethanesulfonic acid, trifluoromethanesulfonic acid, $C_8F_{17}$-sulfonic acid, 3-hydroxypropanesulfonic acid, dioctylsulfosuccinate, 3-pyridinesulfonic acid or p-polystyrenesulfonic acid, or polymeric acid including polystyrenesulfonic acid, polyvinylsulfonic acid, polyamic acid, polyacrylic acid, cellulose sulfonic acid or polyphosphoric acid, but may not be limited thereto.

Hereinafter, the conductive polymer blend composition and the method for preparing the same in the present disclosure are described in detail.

<Preparation of an ICP Molecular Composite Using a PDA>

It is a well-known phenomenon that once the ICP is doped to become a salt of a polymer exhibiting conductivity, the ICP is not easily dissolved in a solvent or melted so that the processing becomes difficult. Here, in order to overcome the problem, the conductive composite is prepared by first blending the ICP and the PDA to make a molecular composite in a processable form, and then, using the molecular composite itself or bending it with a third polymer.

<Polymer-Deaggregating Agent (PDA)>

Since the ICP like polyaniline has a large surface tension and a high solubility factor that cannot be measured, discovering the PDA has been almost impossible. The present disclosure discovered the fact that the ICP like polyaniline is easily blended in a polymer like polyalkylenecarbonate (PAC) having a low glass transition temperature and a high dielectric constant. Here, "easily blended" means that in a composite with the ICP, since PAC viscosity is significantly low compared to a molecular weight, and the solubility factor is high, the PAC does not become particles and the PDA is easily blended at a molecular or nano-dispersion level while forming a continuous phase. In other words, the PDA reduces the attraction of intermolecule or inter-nano-layer of the ICP so as to prevent the flocculation and enable solution- or nano-dispersion or melt-molding. In addition, since the PDA is a polymer, it is different in properties from conventional processing acids having low surface energy and expected to achieve an advantageous effect in improving the brittleness property, which is the intrinsic defect of the ICP.

The PDA is preferably provided by the PAC alone, but may be provided by derivatives of the PAC, i.e., various grafts, blocks or random copolymers, or in a mixture with a polymer having a similar function to that of the PAC and its derivatives. Here, the PAC is an alternating copolymer, of which a repeating structure consists of carbon dioxide and an alkylene oxide, and preferentially indicates polypropylenecarbonate (PPC) and polyethylenecarbonate. According to a catalyst used for copolymerization, ether may be contained in the main chain, but the PAC, of which 85% or more has carbonate bond, is preferable. The weight-average molecular weight of the PAC may be from 2,000 to 450,000, but is preferably from 5,000 to 300,000 according to use. The dispersity is from 1 to 80, but is preferably from 1 to 10. A content of the ICP to the PAC in the ICP/PAC molecular composite may be from 0.1% to 99.9% according to required electrical conductivity, but is preferably in a range of from 2.5% to 95% beyond the percolation limit.

$$—(OCO—C_2H_4)_n— \text{ or } —(OCO—CH_2CH(CH_3))_n— \quad (1)$$

In this formula, n is an integer of about 20 or more.

Unlike aromatic polycarbonate, an alkylenecarbonate has a low glass transition temperature of 60° C. or less, and the cyclic alkylene carbonate (a monomer component) is stable so that when the temperature increases to 180° C., depolymerization occurs. In this case, since no ashes remain in the oxygen atmosphere, the alkylenecarbonate acts as a high boiling point solvent, and thus, may be used as a type of a sacrificial binder, which is blended with the ICP and removed later according to a degree of doping. If the alkylenecarbonate is used as a sacrificial binder, it is easily removed as a whole or in part according to a temperature or the presence of a metal catalyst, and thus, resistance adjustment is easy when preparing a resistor. If the PDA is used as a sacrificial binder, the PDA may be dissolved in a solvent or melted by heat to be removed, and thereby, increasing the surface area, and simultaneously, inducing pores of the interior structure so that the composite may be used as an active material for a storing medium for storing hydrogen, various organic electrodes, capacitors, resistors and sensors. The PAC is a biodegradable polymer, which may form a scaffold component aiding cell growth, and in this case, may be combined with an electric signal to adjust the cell growth. Furthermore, since the PPC has chiral carbons, it is involved in stereo-isomerization and may pursue change of properties by adjusting the stereoregularity. For the PAC used in example embodiments, the monomer (n=1) of the above-described structural formula (1), which is the repeating unit of polyethyleneglycol and polypropyleneglycol, may be combined with another monomer or polymer to form a copolymer in a graft, a block or a random form, or the head-tail regularity or the streoregularity may be made to have gradient upon polymerization so that a selective polymer (n≥20) can be prepared and used. In addition, the end groups —OH and —COOH may be closed, or other polymers may be connected to the end groups or simply physically blended to be used as the PDA.

If the PDA includes a crystalline polymer to be subsidiarily added to the PAC, crystallization of the ICP and crystallization of the component polymer of the PDA would collide with each other, and thus, in this case, it is preferable to first grow the crystal of the ICP polymer, and then, induce the crystallization of the polymer to be added or adopt a polymer capable of inducing the crystallization. For the auxiliary polymer that can be blended and used with the PAC, there are polylactide (homopolymer or one copolymerized with glycolide or lactone); acrylic acid; acrylamide; methacrylic acid; methylmethacrylate; vinylacetate; vinylchloride; N-isopropylacrylamide; methyl acrylate; ethyl acrylate; butyl acrylate; 2-ethyl hexyl acrylate; tertiarybutyl acrylate; tertiarybutyl methacrylate; isobutyl acrylate; 2-hydroxyethyl acrylate; 2-hydroxypropyl acrylate; butanediol monoacrylate; lauryl acrylate; dimethylaminoethyl acrylate; ethyldiglycol acrylate; cyclohexyl methacrylate; N-vinylformamide; N-vinylpyrrolidone; dihydrodicyclopentadienyl acetate; dimethylaminoethyl acrylate; butanediol monoacrylate; 2-hydroxypropyl acrylate; 2-hydroxyethyl acrylate; and 2-hydroxyethyl methacrylate; and a polyvinylphenol and derivatives thereof; and a cellulose modified with hydrophilic groups, for example, hydroxyl, carboxyl, halo, glycidyl, cyano, amino, carbonyl, thiol, sulfonic and sulfonate, —$SO_2Cl$, —$C_6H_5(OH)$ and —COCl; coumarin derivatives; a polyacrylic acid; a polycarprolactone; a polyhydroxybutyrate; a thermoplastic starch; a lignin and so on. Besides, the auxiliary polymer may be blended and used with a polyester such as a polyethylene succinate, a polyethylene adipate, a polytetramethylene adipate, a polyethylene azelate, a polyethylene sebacate, a polydecamethylene adipate, a polydecamethylene sebacate, a poly-α,α-dimethylpropiolactone, a polypivaloyl lactone, a polyparahydroxybenzoate, a polyethylene oxybenzoate, a polyethylene isophthalate, a polyethylene terephthalate, a polydecamethylene terephthalate, a polyhexamethylene terephthalate, a poly-1,4-cyclohexane dimethylene terephthalate, a polyethylene-1,5-naphthalate, a polyethylene-2,6-naphthalate, a poly-1,4-cyclohexylidene dimethyleneterephthalate; a polyamide such as a poly-4-aminobutylic acid, a poly-6-aminohexanoic acid, a poly-7-aminoheptanoic acid, a poly-8-aminooctanoic acid, a poly-9-aminonanoic acid, a poly-10-aminodecanoic acid, a poly-11-aminoundecanoic acid, a poly-12-aminododecanoic acid; and a polycarbonate such as a polymethane bis-4-phenyl carbonate, a poly-1,1-ethane bis-4-phenyl carbonate, a poly-2,2-propane bis-4-phenyl carbonate, a poly-2,2-propane bis-4-phenylcarbonate, a poly-1,1-butane bis-4-phenyl carbonate, a poly-1,1,2-methyl propane bis-4-phenyl carbonate, a poly-2,2-butane bis-4-phenylcarbonate, a poly-2,2-pentane bis-4-phenyl carbonate, a poly-4,4-heptane bis-4-phenylcarbonate, a poly-1,1-1-phenylethane bis-4-phenolcarbonate, a polydiphenylmethane bis-4-phenylcarbonate, a poly-1-cyclopentane bis-4-phenylcarbonate, a poly-1,1-cyclohexane bis-4-phenylcarbonate, a polythio bis-4-phenylcarbonate, a poly-2,2-propane bis-4-2-methylphenylcarbonate, a poly-2,2-propane bis-2-chlorophenylcarbonate, a poly-2,2-propane bis-4-2,6-dichlorophenylcarbonate, a poly-2,2-propane bis-4-2,6-dibromophenylcarbonate, and a poly-1,1-cyclohexane bis-2,6-dichlorophenyl carbonate, but may not be limited thereto. Preferably, the auxiliary polymer may include a member selected from the group consisting of a polylactide, a polyvinylalcohol, a polycarprolactone, a polycarbonate, a polymethylmethacrylate, a polyacrylic acid, a polyhydroxybutyrate, a polyethyleneoxide, a polyvinylpyrrolidone, cellulose derivatives, a thermoplastic starch, a lignin, and combinations thereof, but may not be limited thereto.

<Solution Blending>

In preparing the molecular composite, preparing the ICP and blending dopant and the PDA are essential processes. The PDA is blended in the step for preparing the ICP or is added to a suitable solvent sequentially or simultaneously and slowly part by part while the doping-dedoping is carried out, after the step for preparing the ICP. In this case, an usable solvent is not reacted with dopant and the ICP and is selected from most organic solvents. The organic solvent may be, for example, a chloridized solvent like methylene chloride, chloroform, trichloroethylene or tetrachloroethylene; alcohols such as n-butyl alcohol, sec-butyl alcohol, tertiary-butyl alcohol, isobutyl alcohol, and so on; ketones such as acetone, methyl ethyl ketone, diethyl ketone, propylene carbonate, and so on; ethers such as dioxane, tetrahydrofurane, and so on; cyclic amines such as 2-methyl-N-pyrrolidone, pyrrolidone, and so on; aromatic amines such as pyridine, pyrrole, and so on; and amines such as dimethylformamide, dimethylsulfoxide, and so on, but may not be limited thereto. Preferably, the organic solvent may be methylene chloride, chloroform, trichloroethylene, tetrachloroethylene, m-cresol, dimethylamide, ethyl acetate, dimethyl sulfoxide, tetrahydrofurane and N-methyl-2-pyrrolidone, and more preferably, methylene chloride, chloroform, trichloroethylene, m-cresol, γ-butylactone, and 2-methyl-N-pyrrolidone, but may not be limited thereto.

These solvents may be used individually or in combinations thereof, or in a mixture with water. Examples for an aqueous acid solution may be dichloroacetic acid, 80% acetic acid, and from 60% to 88% formic acid, but may not be limited thereto.

For the blending process, a bead mill and a mechanical stirring may be used together or ultrasonic waves may be used. For the stirring condition, in a nitrogen atmosphere or air, and a temperature of from about 0° C. to about 100° C. are preferable, and a temperature not exceeding about 50° C. is more preferable. Stirring time may be less than about 12 hours or maximum about 48 hours, and preferably, is less than 24 hours.

In preparing the composition, a content of the PDA may be adjusted in a range of from about 0.1% to about 99.9% for a weight ratio of the ICP according to use, and a content of dopant may be added in the manner that it does fall short of or exceeds an equivalence ratio so as to adjust the conductivity.

In the blend, an ICP aggregate or precipitate in a small quantity and a certain size or larger may be separated and removed by common methods such as filtering and centrifugation. Or, in order to reduce the aggregate or precipitate, a small amount of an inorganic salt like LiCl may be used, bead mill or a mechanical crushing method may be used, or various methods such as washing and drying may be used at the same time.

<Melt Blending>

The ICP, the dopant, and the PDA may be blended with one another by a melting method to prepare the molecular composite. The ICP/dopant and the PDA may be melt-blended at a temperature ranging from about 160° C. to about 240° C., but the temperature is preferably kept at about 200° C. or less. A single axis, a twin-screw or multi-screw extruder and a chaotic mixing head may be used, and a 0.1 phr antioxidant is added while performing the blending for short time of less than about 20 minutes at a screw rotation velocity of from about 100 rpm to 300 rpm.

<Doping Characterization of Molecular Composite>

To identify the structure of the compound, NICOLET system 800 was used for IR, and Jasco V-570 was used for UV. To measure a thickness, the Tencor P-10 super surface profiler was used. To prepare a spin coating film, the spin coater of HEADWAY RESEARCH INC is used.

For the molecular weight of the polymer, GPC (Waters Millennium) and the polystyrene standard material were used, the ICP is dissolved in the NMP solvent, 0.5% LiCl is added thereto to prevent aggregation, and the PAC is measured in the THF solvent at 35° C.

To measure the electrical conductivity of the polymer film, Source-Measure Units Model 237 of KEITHLEY is used. For the TGA and DSC used for identification by thermal analysis, TGA Q50 and DSC Q10 of TA are used, and for particle size analysis, FPAR-1000 of Photal is used. For elemental analysis, Flash EA1112 of CE INSTRUMENTS is used. For mechanical characteristics of the film specimen, UTM 5900 of Instron is used, and for an impact test, Charpy strength is measured while meeting the specimen size of 2 mm×1 mm×10 mm.

<Third Polymer>

The PDA/ICP molecular composite is a type of a masterbatch and may be blended with another polymer, a polymer nanofiber, a glass fiber, a carbon black, a carbon nanotube, a graphite, a graphene or others to prepare the final composition. As a binder type of a polymer that can be used in that case, the following a thermoplastic polymer or a polymer modified by a copolymer having a slightly changed structure may be used: an acrylonitrile butadiene styrene (ABS), an acetal acrylic LCP's (liquid crystal polymer), a polybutylene terephthalate (PBT), a polycarbonate, a polyester, a polyetherimide, a polyethersulfon, a polyethylene, a high-density and low-density polyethylene terephthalate (PET), a polyphenylene oxide (PPO), a polyphenylene sulfide (PPS), a polypropylene, a polystyrene, a polyurethane, a polyvinyl chloride) (PVC), a styrene-acrylonitrile (SAN) copolymer, a polytetrafluoroethylene, a polyvinylfluoride, a polyvinylidenefluoride, a polychlorotrifluoroethylene, a polyvinylidene hexafluoropropene, tetrafluoroethylene, chlorofluoroethylene, nylon, a polyester and thermoplastic elastomer (TPE), a methyl methacrylate polymer, an ethyl methacrylate polymer, a polyvinyl acetate, a polystyrene, a styrene-olefin copolymer, a polyurethane, a polyvinyl formal, a polyvinyl butyral, a polycarbonate, a cellulose ester, a cellulose ether, an acrylamide polymer, a vinyl fluoride ether polymer, a vinyl pyrrolidone polymer, an ionic polyether, an ionic acrylonitrile-vinylidene chloride polymer, a methylcellulose, a cellulose nitrate, a gelatin, gelatin derivatives or polysaccharines, a polysulfon, each of the polymers or a blend of two (2) or more of the polymers, and the polymers modified with the hydrophilic groups of —$SO_3H$, —$SO_2Cl$, —$CO_2H$, —OH, —$C_6H_5$(OH), and —COCl may be used. In this case, in order to supplement the properties, a surfactant may be added, and examples for the surfactant are described below:

<Surfactant>

A surfactant in accordance with the present disclosure may be an anionoid surfactant, and preferably, a surfactant having a strong anionoid part such as sulfonate, sulphate, phosphate and phosphonate as a hydrophilic group, but may not be limited thereto. The most preferable group may include sulfonate or sulphate, but may not be limited thereto. Examples for a compound universally known as a detergent are as follows: alkyl sulfonate, alkyl benzene sulfonate, naphthalene sulfonate, α-olefin sulfonate, lignosulfonate, dialkylsulfonate, taurate, alkyl sulphate, ethoxylated sulphate, ethoxylated and sulphated alkyl phosphate ester, and phosphonate.

Besides, a member selected from the group consisting of carboxylate, glycerol ester, a carboxyl amine polyoxyethylene, a polyalkylene oxide, a poly(oxyethylene-co-oxypropylene), an aliphatic amine, an alkylamine ethoxylate, an amine oxide, an alkoxylate of ethylenediamine, imidazoline, a quanternary ammonium salt, imidazolinium derivatives, an alkylbetaine, and amidopropyl betaine, may be used, but may not be limited thereto.

The PDA/ICP molecular composite is a type of a masterbatch and can improve the heat resistance and the curing resistance by using a thermoplastic binder type of a polymer. As the thermoplastic resin, an alkyd, an epoxy, a polyimide, a polyurethane, a unsaturated polyester, an amino resin, and a phenol resin may be used. More preferably, an epoxy resin using an acid anhydride type of a curing agent, a phenoxy resin, a polyimide precursor using a polyamic acid, and an alkyd resin are used.

Hereinafter, the present disclosure is described in detail by using Examples. However, the present disclosure is not limited to the Examples.

EXAMPLES

Example 1

Synthesis of Polyaniline (PANi, EB)

An emeraldine base was synthesized to prepare a conductive polymer polyaniline molecular composite. After a cooling circuit was provided in a 1,000 mL double-jacket reactor, a reaction temperature of the reactor was set to 0° C., and 800 mL 4 N HCl and 20.0 g refined aniline were put into the reactor and dissolved for 30 to 35 minutes; thereafter, while a solution obtained by dissolving 11.44 g ammonium persulfate in 200 mL 4 M HCl was titrated by a titrator for 50 minutes in the reactor, in which the aniline was dispersed, the reaction solution was polymerized until it changed its color from blue to deep blue. After the polymerization was finished, the reaction solution was filtered by a 2 μm filtering paper and the Büchner funnel and washed with distilled water and methanol to obtain a precipitate; and then, the precipitate was put into 800 mL 0.1 M $NH_4OH$ and stirred for 24 hours so as to be de-doped. After the stirring, the reaction solution was filtered and dried in a vacuum oven set to 50° C. for 48 hours so that a black emeraldine base (EB) of polyaniline was obtained.

Measurement of Viscosity (I.V.) of a Polyaniline Emeraldine Base (EB)

In order to measure viscosity of the synthesized polymer, 10 mg polyaniline (EB) was dissolved in 10 mL concentrated sulfuric acid for about 30 hours so that a polymer solution was prepared. Viscosity (intrinsic viscosity; I.V.) of the sample solution was measured by using the Ubbelohde viscometer at 30° C. For stabilization of the measurement temperature, the sample solution was immersed in a thermostat for about 1 hour; thereafter, viscosity of the concentrated sulfuric acid used as a solvent was first measured, and then, viscosity of the polymer solution was calculated by comparing the polymer solution and the concentrated sulfuric acid, which is the reference solvent, and by using the following formula:

$$\eta_{inh} = \frac{\ln(\eta/\eta_s)}{c};$$

$\eta_{inh}$: Intrinsic viscosity

η: Viscosity of the solution $\mu_s$: Viscosity of the solvent c: Concentration

Measurement of Electrical Conductivity

Resistance of a sample is related to length and a cross-section area of the sample, and when D.C. current and voltage are applied, the following relationship to an amount of D.C. resistivity is established: R=ρL/A. Here, ρ refers to resistivity and has a unit of ohms-cm. L refers to length and is indicated by cm. A refers to a cross-section area of the sample and is indicated by $cm^2$. All different materials have different resistivity. The reciprocal of D.C. resistivity is D.C. conductivity and uses the unit of ohm $s^{-1}cm^{-2}$ and the unit of S/cm (siemans per cm) for IUPAC. The conductivity is the same in identical materials prepared under the same condition and can be effectively used to discriminate the materials from other materials.

With respect to a material having metallic conductivity, there is a case where electrical contact resistance between a probe and the sample is higher than resistance of the sample itself once in a while. For this reason, the simple two-probe method is not generally used. The problem can be resolved by using the four-probe method.

Measurement of Film Conductivity

Electrical conductivity of the film was measured by using the four-probe method to remove contact resistance between a gold wire electrode and the sample. The film and the gold wire were contacted by using a carbon paste, and thickness of the film was measured by using the micrometer of Mitutoyo.

Current and voltage were measured by using Source-Measure Units Model 237 of KEITHLEY. With respect to the measuring method, when certain source current (I, DC current) was applied to external two (2) probes, a resultant voltage difference (V) was measured in internal two (2) probes. Upon the measurement, the source current was based on the area where voltage linearly increased at current double the current of 100 μA, 1 mA and 10 mA, and compared with a voltage difference measured in case of the source current of 200 μA, 2 mA, or 20 mA.

The electrical conductivity was calculated by using the following formula:

$$\sigma=(I)(l)/(d\times t)(V);$$

σ: Electrical conductivity (S $cm^{-1}$, the reciprocal of Ωcm)

I: Certain source current (DC current) (A) applied to the sample

V: Voltage (V) measured when the certain source current was applied t: Thickness (cm) of the film l: Length between electrodes d: Length of the film in contact with the probes (width of the film)

Figure 13:
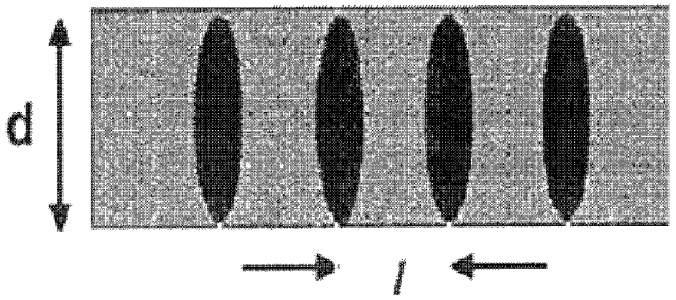
FIG. 13 shows electric conductivity measurement by a four (4)-probe method.

For example, FIG. 13 shows the electrical conductivity measurement by the four-probe method for a freestanding film.

Preparation of a Doped Polyaniline (ES) Film

The film was prepared after CSA[(1S)-(+)-10-camphorsulfuric acid, 99%] and EB were prepared by dissolving such that a total amount of the polymers was 1.5 weight % to m-cresol when a molar ratio of the repeating unit (tetramer) and CSA was 1:2.

Example 2

Preparation of the ES/PPC In-Situ Molecular Composite

For the PPC, GreenPol (weight-average molecular weight: 36,000, dispersity: 1.6) that was developed by SK Energy corp. by reacting carbon dioxide and propyleneoxideunder a cobalt-salen catalyst was used.

Figure 6:
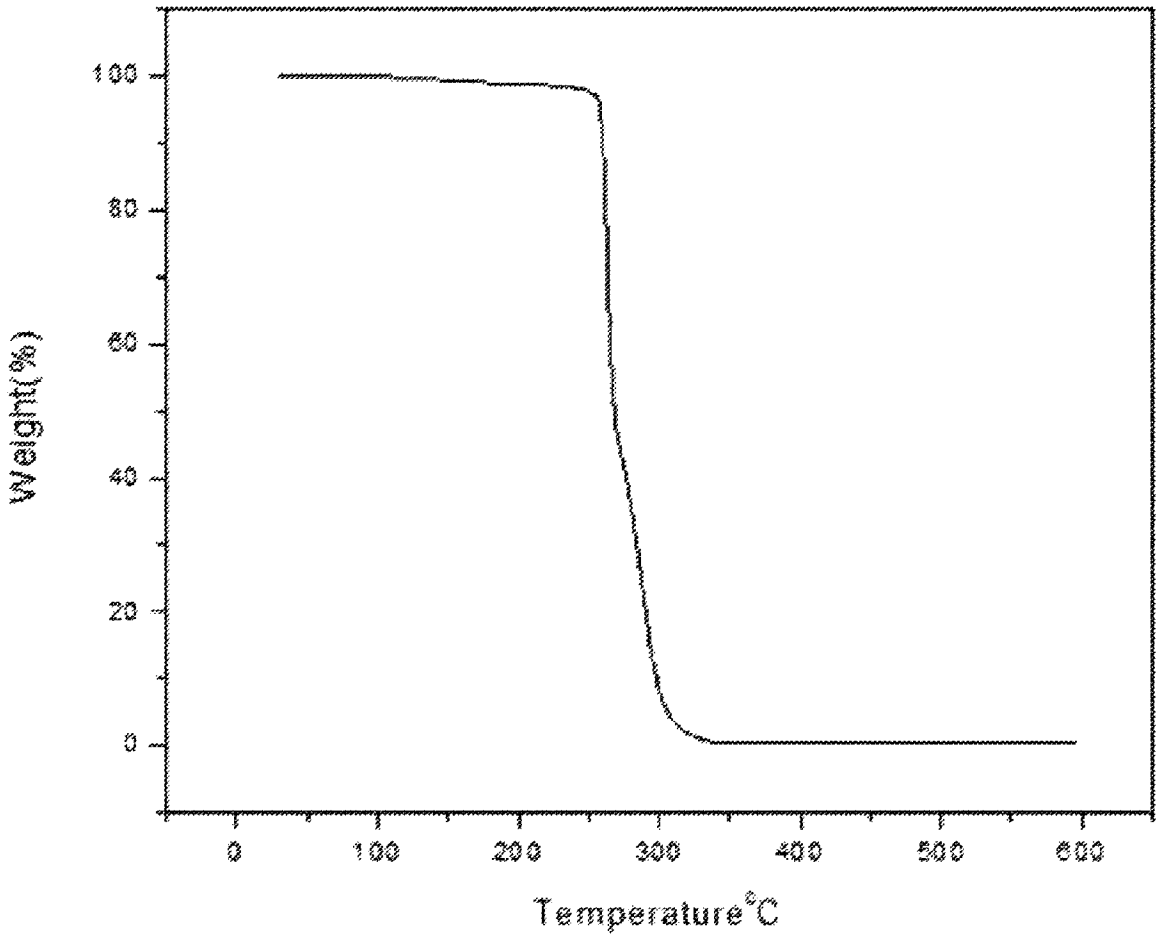
FIG. 6 is a graph showing a TAG curve of the PPC.

First, the PPC was dissolved in chloroform to be 3% compared to polyanilne, and put into a 1,000 mL double-jacket reactor provided with a cooling water circulator. After the cooling circuit was provided in the reactor, a reaction temperature of the reactor was set to 10° C., and 800 mL 2 N AMPSA and 20.0 g refined aniline were put into the reactor and dissolved for 240 to 350 minutes. Thereafter, while a solution obtained by dissolving 11.44 g ammonium persulfate in 200 mL 2 N AMPSA was titrated by a titrator for 50 minutes in the reactor, in which the aniline was dispersed, the reaction solution was polymerized until it changed its color from blue to deep blue. After the polymerization was finished, the reaction solution was filtered by a 2 μm filtering paper and the Büchner funnel and washed with distilled water and methanol to obtain a precipitate; and then, the precipitate was put into 800 mL 0.1 M $NH_4OH$ and stirred for 24 hours so as to be de-doped. After the stirring, the reaction solution was filtered and dried in a vacuum oven set to 50° C. for 48 hours so that a black polyaniline emeraldine base (EB) was obtained. After polymerization was performed in the same manner as described above, methanol was added in the same volume as that of the reaction medium to the reactor before filtering by a filter, and then, stirred for 3 hours and filtered; thereafter, a filtered material was washed, de-doped and dried in the same manner as described above so that the base was obtained. As shown in FIG. 1, it is identified by TAG thermal analysis that 3.5% PPC and 25% PPC were respectively blended, and the PPC content can be adjusted in the polymerization process. In comparison, FIG. 6 is a graph showing the TGA curve of the PPC.

Example 3

Preparation of the ES/PPC Molecular Composite

For the PPC, GreenPol (weight-average molecular weight: 153,000, dispersity: 1.6) that was developed by SK Energy by reacting carbon dioxide and propyleneoxide under a cobalt-salen catalyst was used.

Doped polyaniline (EB/CSA) was dissolved in advance in a NMP solution, and PPC was added thereto by the amounts of 17% and 23%, such that a total amount of the polymers was 2.5 weight % to the solvent. Polyaniline (EB) and CSA[(1S)-(+)-10-camphorsulfuric acid, 99%] were uniformly ground to be subject to solid blending, the blended powders were put into NMP and dissolved by using a homogenizer at a velocity of 24,000 rpm for 10 minutes. A PPC chip was put into the solution to be dissolved for one day, and then, stirred with a homogenizer at 13,000 rpm five times for 3 minutes per time. After part of the prepared solution, which was not dissolved, was eliminated by using a syringe filter and a syringe, a film was prepared through solution casting. A glass plate (2.5 cm×2.5 cm×0.1 cm) for the film casting was immersed in aqua regia for 4 hours or longer and taken out, and the surface of the plate was washed with secondary distilled water and ethanol. About 3 mL of the filtered solution was applied onto the glass plate placed on a hot plate set to 40° C. to 50° C. and dried for 48 hours or longer so that the film was prepared.

With respect to compatability of the molecular composites, it was identified by using FTIR, DSC, TGA, X-ray and SEM that the molecular composites were formed at a molecular level. UV-vis and NIR results identified polaron formation according to the doping, and the electrical conductivity was calculated by measuring resistance on the film.

Figure 2:
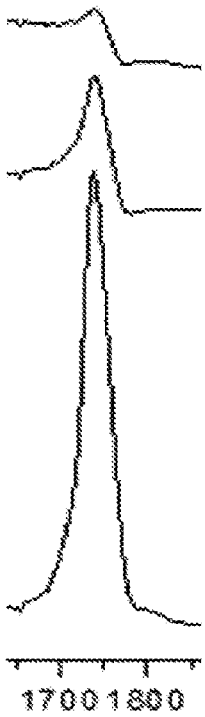
FIG. 2 shows change of a CO peak in a FTIR spectrum of an ES/PPC blend according to a content of the PPC in an example embodiment of the present disclosure (the top: 30%, the middle: 20%, and the bottom: 0%).
Figure 3:
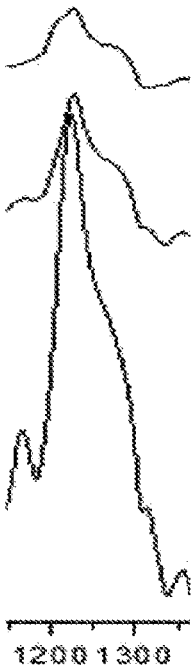
FIG. 3 shows change of an OCO peak in a FTIR spectrum of an ES/PPC blend according to a content of the PPC in an example embodiment of the present disclosure (the top: 30%, the middle: 20%, and the bottom: 0%).
Figure 4:
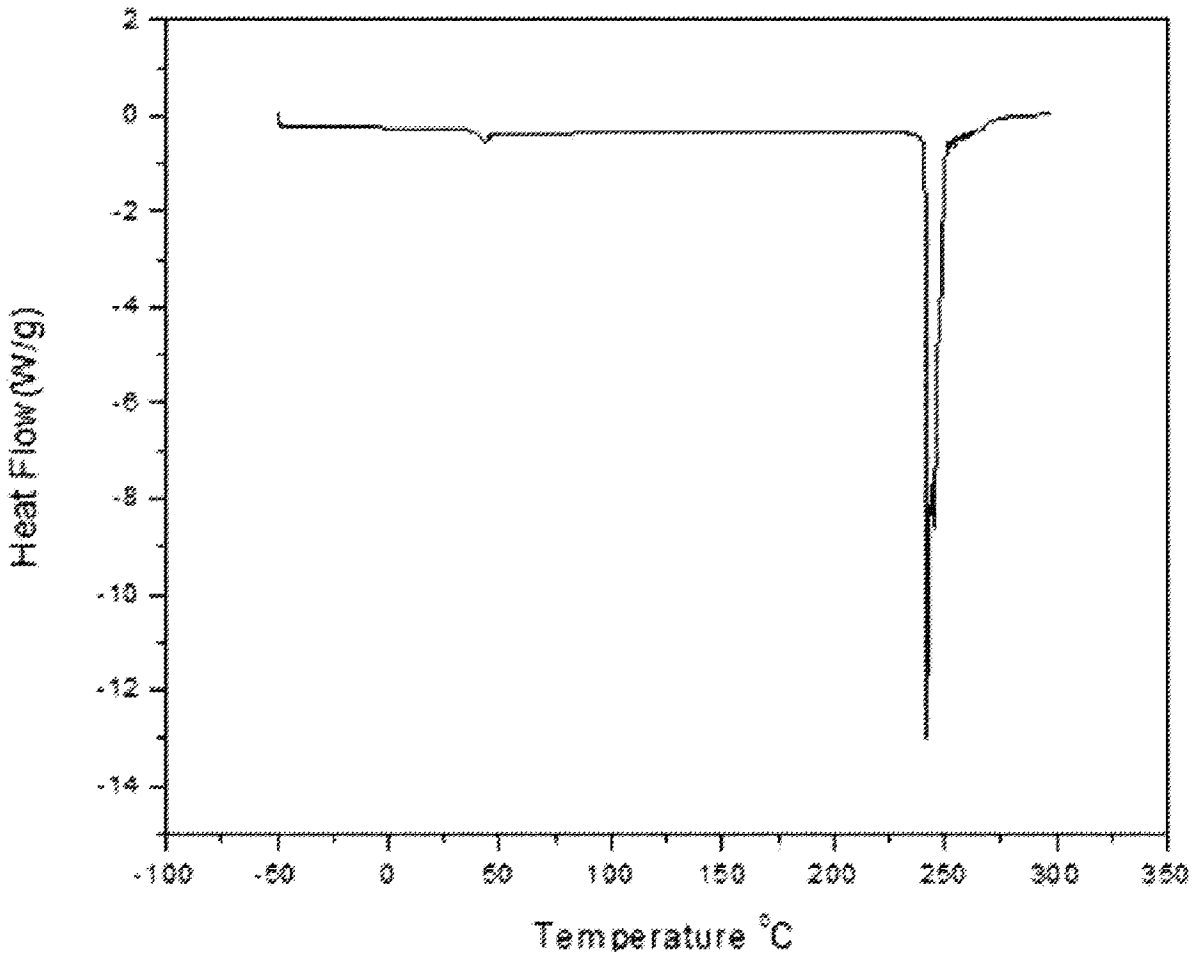
FIG. 4 is a graph showing a DSC curve of the PPC.
Figure 5:
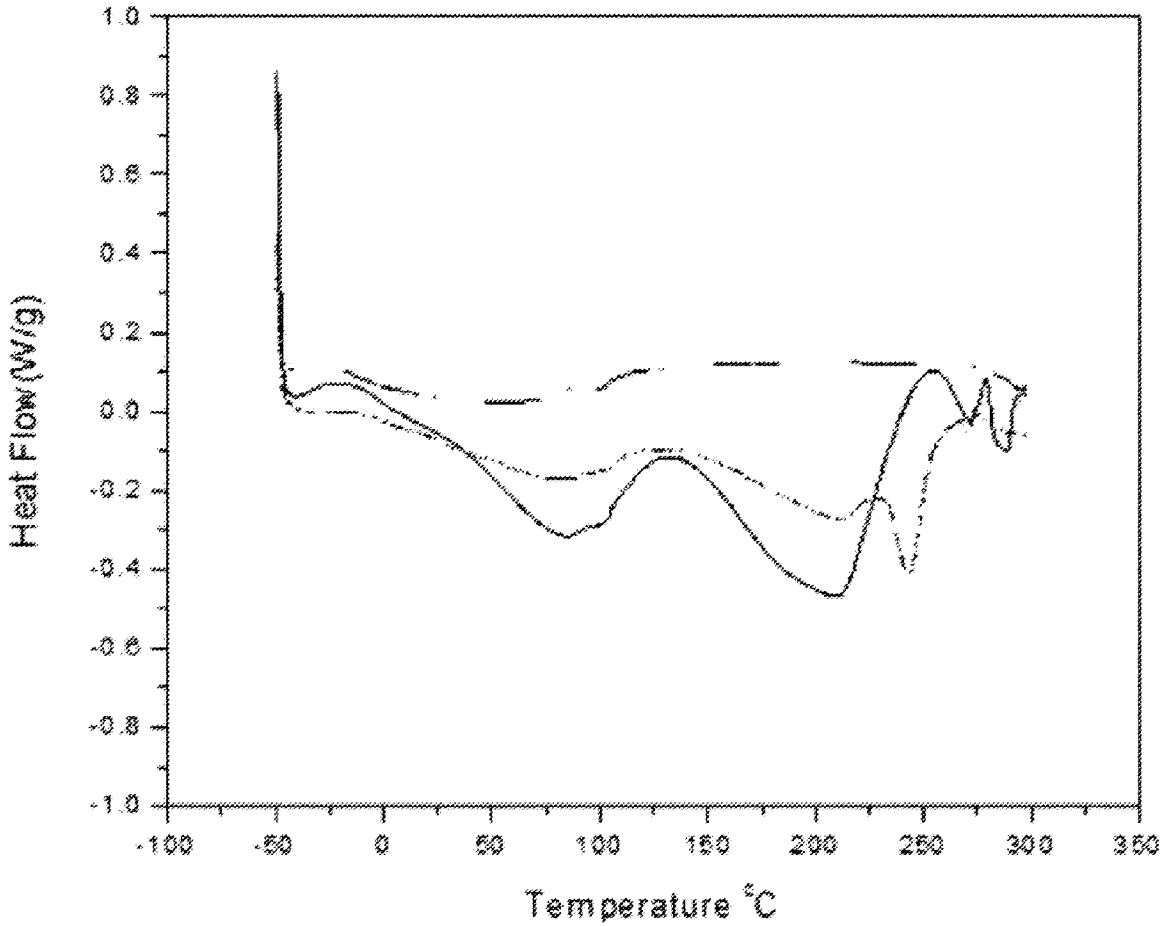
FIG. 5 is a graph for comparison of DSC curves of an ES/PPC blend according to a content of the PPC in an example embodiment of the present disclosure (three-dot curve: 30%, two-dot curve: 20%, and unbroken line: 0%).
Figure 7:
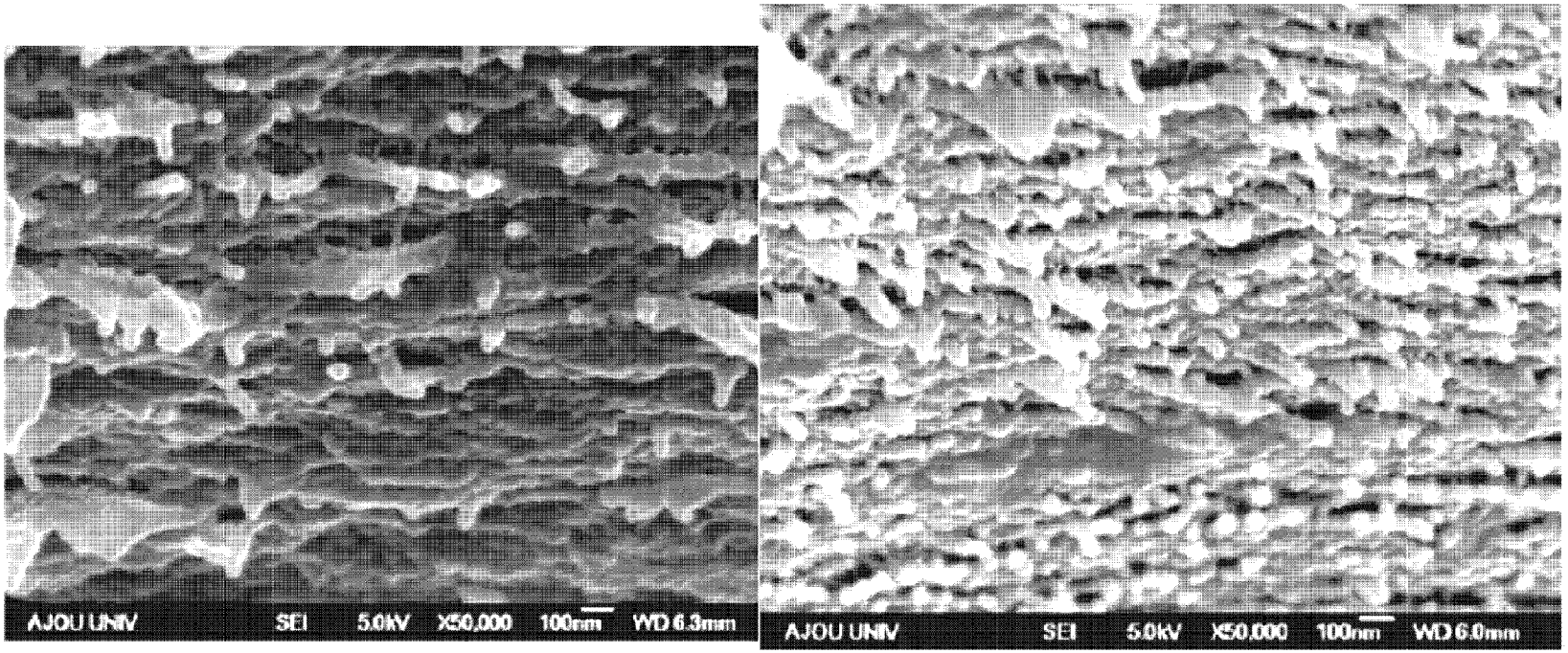
FIG. 7 shows SEM images in an example embodiment of the present disclosure.
Figure 8:
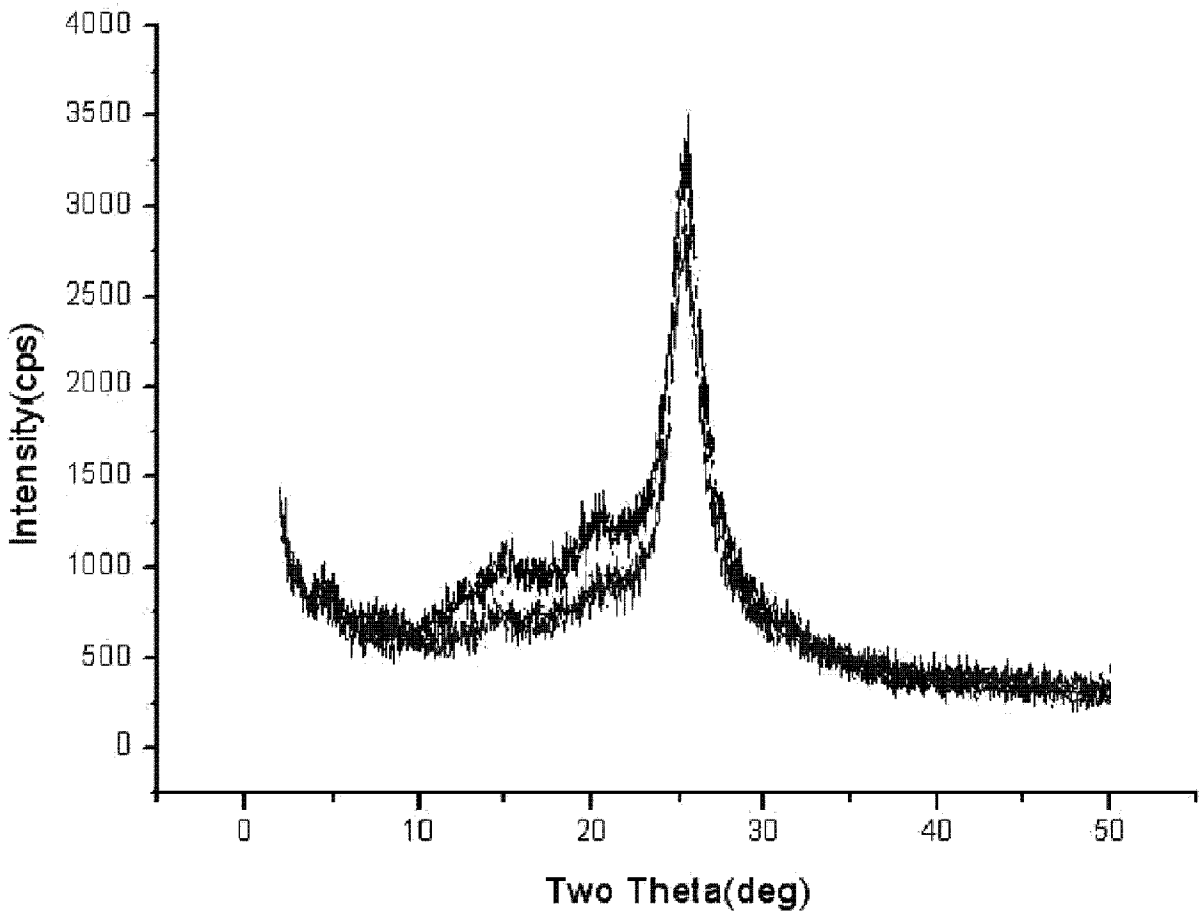
FIG. 8 is a graph showing an X-ray diffraction spectrum in an example embodiment of the present disclosure.

As to the IR peak shown in FIG. 2, the peak of the carbonyl group of the PPC appears at 1738 $cm^{-1}$ but becomes wider in the direction of the long wavelength as the PPC is blended with ES so that C═O . . . H—N— is formed between the polymers, and thus, molecular-level blending can be seen, and the O—C—O peak moved toward the short wavelength by 5 cm according to hydrogen bond formation (FIG. 3). FIG. 4 is a graph showing the DSC curve of the PPC, and upon comparing with the DSC curve of the ES/PPC blend in FIG. 5 in accordance with the present Example, in the DSC of FIG. 5, as the glass transition temperature peak of the PPC disappeared, and only the wide endothermic curve was observed near 140° C., it can identify that the molecular composite was formed. FIG. 7 shows electron microscopy images of the film before and after the PPC blending. As a result of the fracture surface analysis for the ES, it is observed that ES particles are formed in a nanofiber form having a diameter of 20 to 80 nm and an aspect ratio of 1 or more, and a continuous phase of the PPC, rather than dispersion of particles, are formed in the specimen in which the PPC was blended. Especially, the X-ray results suggest positive outcome since when the PPC is blended, the whole crystallizability is reduced, whereas there is no change in the peak of the stacking of the benzene rings (FIG. 8). The PPC added together was believed to have been easily blended with the dopant layer and easily blended into tunnel layers among ES columns.

Examples 4 to 7

ES/PDA Molecular Composite

UV-Vis-NIR Spectroscopic Analysis

Figure 9:
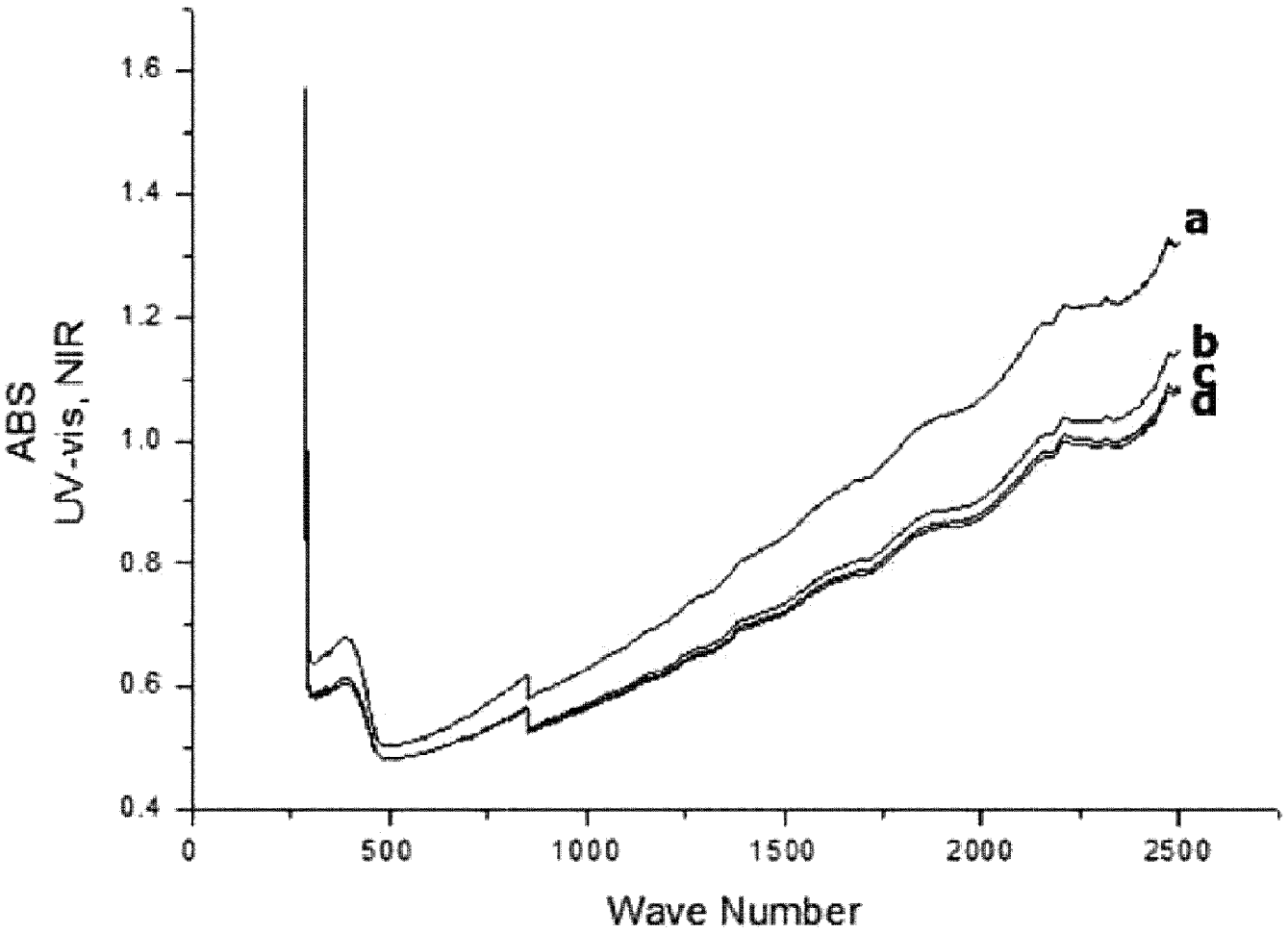
FIG. 9 is a graph showing UV-vis ES/PPC results in an example embodiment of the present disclosure.

After EB/CSA was dissolved in a m-cresol solvent in the same manner as that in Example 3, PPC, a PPC copolymer to which a polypropyleneglycol block is connected (number-average molecular weight: 35,000, dispersity: 2.78), PPC/PAA (polyacrylic acid, a volume ratio of 2:1), and PPC/PLA (polylactic acid, a volume ratio of 2:1) were added thereto in a weight ratio of 23% per the polymer. An initiator of the PPC copolymer was synthesized and used in the manner that polypropylene glycol (molecular weight of 430 g/mol, 0.8 mol %) and a catalyst (0.05 mol % double metal cyanide) were put into a polymerization reactor and reacted with propyleneoxide (14.0 mL, 200 mmol) at 70° C. by means of $CO_2$ (pressure of 3.2 MPa). The solutions were spin-coated on a quart plate to prepare a thin film having a thickness of 0.1 μm to 0.2 μm, and then, analyzed by UV-vis-NIR spectroscopy. As shown in FIG. 9, absorption appears near 420 nm and linearly increases up to the zone of the 2500 nm near IR such that the absorption peak of polaron transition and the free-carrier tail are clearly seen. When comparing the four (4) specimens, the ES/PPC film exhibited the highest absorbance, followed by the PPC copolymer, the PPC/PPA and the PPC/PLA. However, from the fact that the EB state where all the four (4) samples were not doped did not appear, and a localized polaron peak did not also appear near 800 nm, it was believed that the conductive molecular composite was formed.

Measurement of Resistance of the Film

As a result of measuring the resistance of the four (4) films by using the two-probe method, the resistance range was from 9Ω to 430Ω, and the level of the resistance exhibited an opposite tendency to the level of the UV-vis absorbance.

Example 8

Polyaniline Copolymer/PPC Molecular Composite

Figure 10:
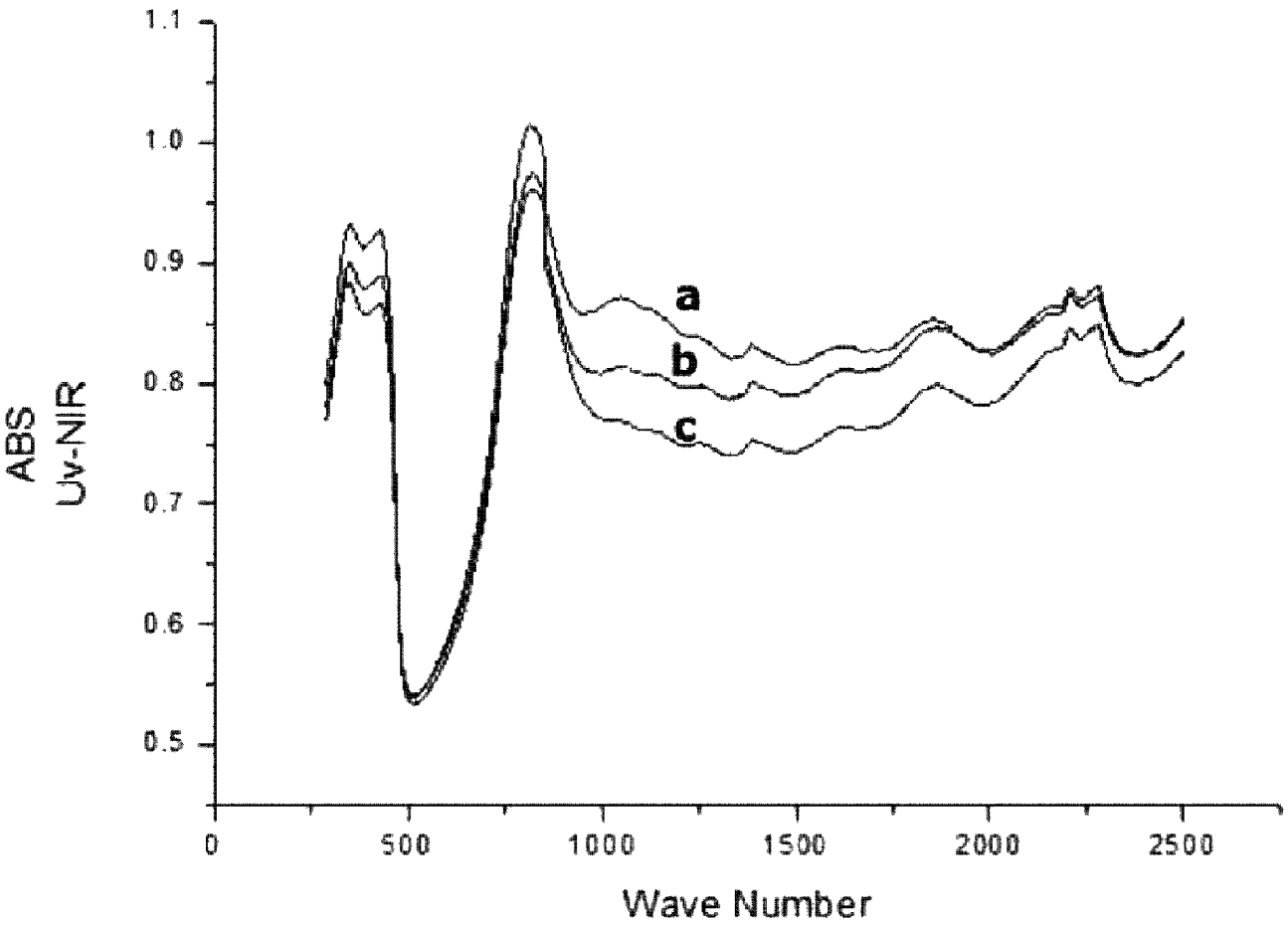
FIG. 10 is a graph showing a UV-vis PANi copolymer/PPC in an example embodiment of the present disclosure.

An aniline monomer and 2,6-dihydronaphthalene were blended in a ratio of 1 mol % to the aniline and synthesized in the same method as that of Example 1 so that EB was prepared. The PANi copolymer/the PPC molecular composite were prepared in the same manner as that of Example 3, UV-vis spectrums thereof were studied, and the results are shown in FIG. 10. It was identified that the intrinsic viscosity was low, and the degree of aggregation of chains of the copolymer was reduced, and it was found that the doping closely related to the electrical conductivity was effectively accomplished, and the polaron band was being properly formed.

Example 9

PPC Molecular Weight Change of the ES/PPC Molecular Composite

Figure 11:
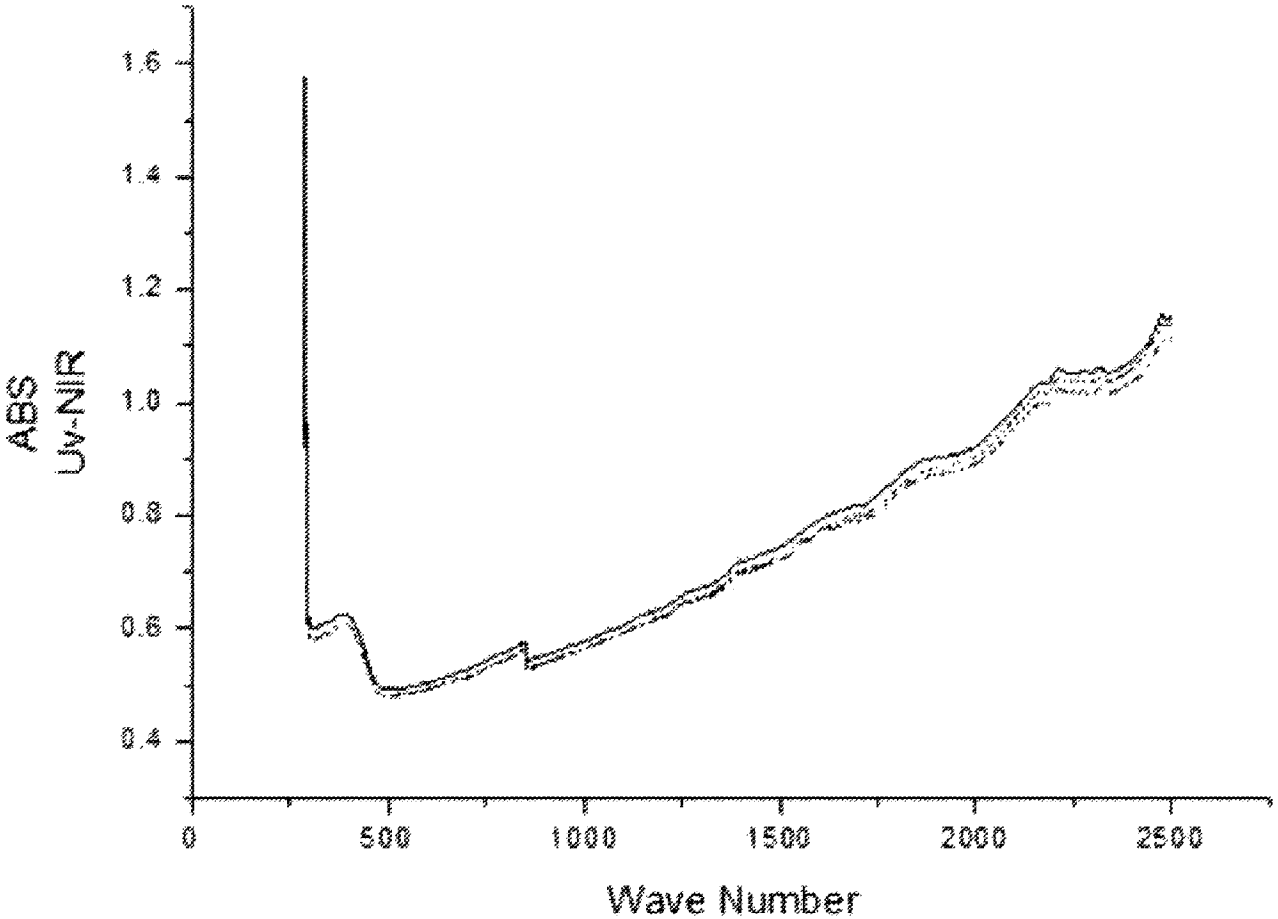
FIG. 11 is a graph showing absorbance of UV-vis ES/PPC according to a molecular weight of the PPC in an example embodiment of the present disclosure.
Figure 12:
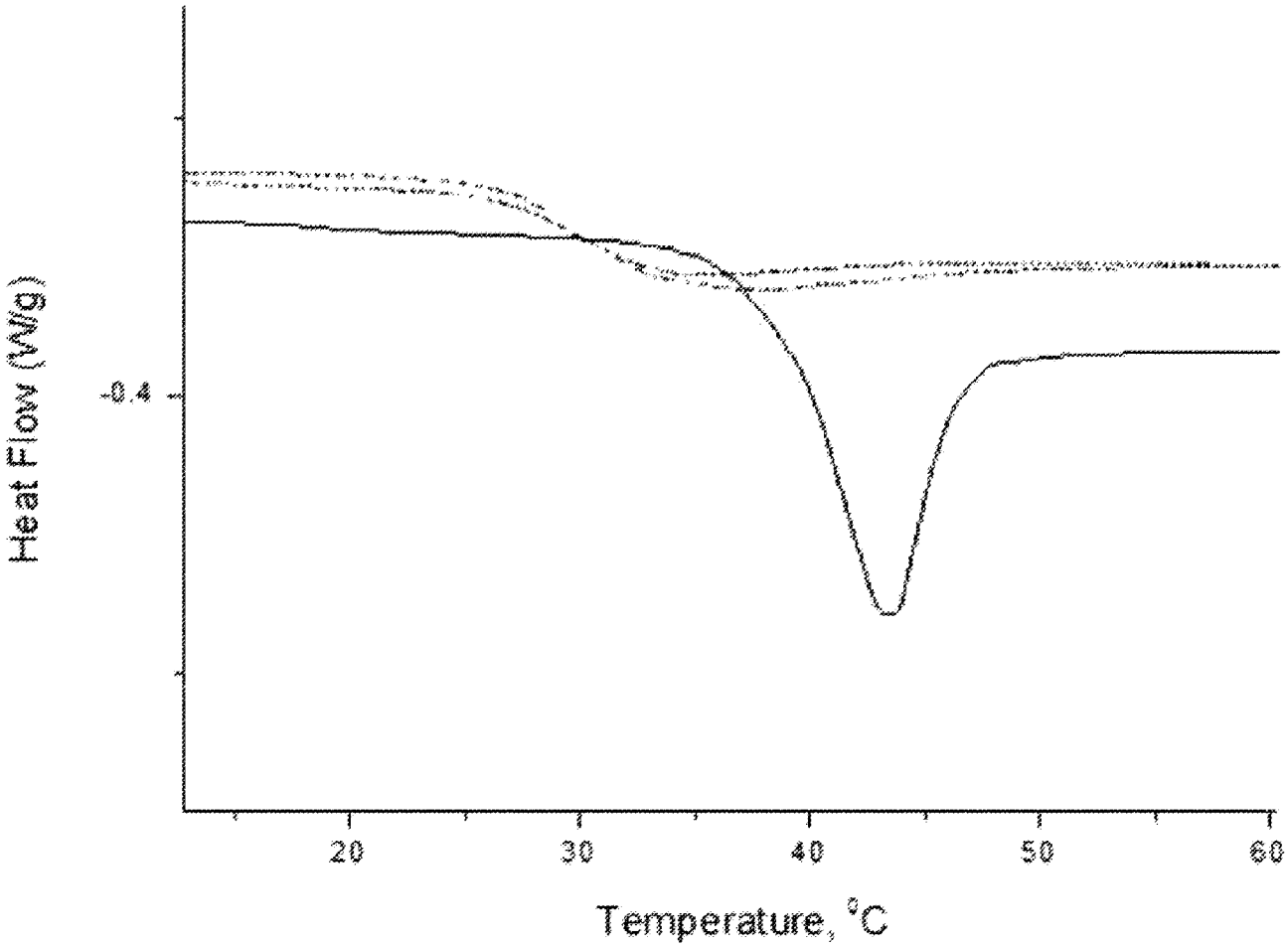
FIG. 12 is a graph showing a DSC curve (unbroken line) according to a molecular weight of the PPC in an example embodiment of the present disclosure.

Effect of the PPC molecular weight of an ES/PPC molecular composite was studied. As the PPC, polymers having a weight-average molecular weight of 149,000, 203,000 and 346,000 and dispersity of 1.7 were used, and EB/AMPSA (2-acrylamido-2-methyl-1-propansulfonic acid) was prepared in the same manner as that of Example 2 to measure a delocalized polaron absorption peak and a DSC curve as shown in FIG. 11 and FIG. 12. Among the three (3) molecular weights, the polymer having the molecular weight of 203,000 exhibited the highest absorbance, and the other two polymers exhibited similar absorbance. This implies that it is preferable to adopt PPC having a proper molecular weight according to selection of dopant.

Example 10

ES/PPC Molecular Composite/Alkyd Composition

After an ES/PPC molecular composite solution was prepared in the manner described in Example 3, the solution was freeze-dried to remove the solvent and ground in a mortar to become powders. The powders were put into an alkyd resin binder (molecular weight of 67,000, —OH value of 38 mg KOH/g oil) and blended to be a concentration of 8% by using Netzsch bead mill. To stabilize the dispersion system, mono-glyceride and cobalt-octoate were added in a small amount. The composition coating exhibited the high surface conductivity of 2.5 S/cm, from which corrosion prevention or electromagnetic shield can be expected.

Example 11

ES/PPC Molecular Composite/PVDF Composition

Since PVDF (Kynar 721) is a hydrophobic polymer, it was modified to have hydrophilicity. PVDF powders were immersed in concentrated chlorosulfonic acid for 9 minutes for surface sulfonation. For comparison, PVDF powders were immersed in MEA (monoethanolamine), instead of chlorosulfonic acid, at 80° C. for 60 minutes, and then, washed and used. A UV-vis spectrum of a solution obtained by dissolving ES, which was obtained from doping EB of Example 1 with p-toluenesulfonic acid, and the modified PVDF in NMP in a weight ratio of 4:1 was studied. A localized polaron peak appeared near 800 nm, and absorption from delocalized polaron transition appeared in the NIR area. Compared to non-modified PVDF, the modified PVDF exhibited low localization and high delocalization, namely, superior conductivity can be expected, and the MEA treatment among the modification methods was showed a lower conductivity than the sulfonic acid treatment. The modified PVDF-503H and 500 ppm PVDF-HFP (Polyvinylidene fluoride-co-hexafluoropropene) having a low melting point were blended, and further blended with ES/PPC powders prepared in the same manner as described in Example 9 so as to manufacture a sheet through compressive processing. The sheet was manufactured through molding for 5 minutes at a compression temperature of 210° C. and an atmospheric pressure of 200. The sheet was cut to be of a dog-bone shape, and then, subject to a tensile test. The tensile strength was 36 to 45 MPa, elongation at break was 48 to 54%, and Young's Modulus was 0.9 to 1.3 GPa. A thickness of the sheet was 27-48 μm, and the surface resistivity was $3.2\times10^3$ ohm-cm. As a result of the effect of the PPC, deflection at break was not significantly deteriorated, and the properties were maintained at the PVDF level.

Example 12

ES/PPC Molecular Composite and Carbon Electrode

For the ES/PPC molecular composite, PPC was dissolved in methylene chloride in a weight ratio of 20% to EB upon the polymerization, added to a reactor, and polymerized by the same method as that of Example 1. The reactant was washed with methanol until its color no longer appears and dried so that ES/PPC in a fine powder form was prepared. The ES/PPC particles were prepared as a type of preform, and a PVDF binder was put thereinto and blended in a weight ratio of 1:1. For comparison, carbon black, instead of ES/PPC, was put thereinto, and the process was repeated. The blend was dissolved and blended in NMP in a concentration of 25%, and a 1% carbon nanotube was added thereto to make slurry. The slurry was stirred with ultrasonic waves (100 W) at 0° C. for 30 minutes and blended again with a Z-blade stirrer for 24 hours. After the blend solution was casted on a polypropylene film by using a doctor blade, a sheet was prepared by using a 180° C. hot-press. The surface resistance of the sheet is 280 ohm/□, and the variation at 85° C. and 85% humidity for 10 days was within ±3. To the contrary, in case of using carbon black, the surface resistance was 3.8 kilo ohm/□.

The above description of the example embodiments is provided for the purpose of illustration, and it would be understood by those skilled in the art that various changes and modifications may be made without changing technical conception and essential features of the example embodiments. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the example embodiments. It shall be understood that all modifications and embodiments conceived from the meaning and scope of the claims and their equivalents are included in the scope of the inventive concept.

We claim:

1. A method for preparing a conductive polymer blend composition, comprising:

blending a conductive polymer and a polymer-deaggregating agent to form a molecular composite, wherein the polymer-deaggregating agent comprises at least one of a polyalkylenecarbonate polymer, a copolymer thereof or derivatives thereof.

2. The method for preparing a conductive polymer blend composition of claim 1, wherein the polymer-deaggregating agent is used as a sacrificial binder.

3. The method for preparing a conductive polymer blend composition of claim 1, wherein the conductive polymer includes a member selected from the group consisting of a polyparaphenylene, a polyparaphenylenevinylene, a polyaniline, a polyazine, a polythiophene, a poly-p-phenylene sulfide, a polyfurane, a polypyrrole, a polyselenophene, a polyacetylene, and combinations thereof.

4. The method for preparing a conductive polymer blend composition of claim 1, wherein the conductive polymer includes a polyaniline.

5. The method for preparing a conductive polymer blend composition of claim 4, wherein the polyaniline includes a polyaniline substituted and modified by a group selected from the group consisting of an alkyl group; an alkenyl group; an alkoxy group; an alkoxyalkyl group; a thioalkyl group; a cyano group; a halogen group such as fluorine, chlorine, bromine and iodine; an alkoxyaryl group; an alkoxycarbonyl group; an aryl group; an oxyaryl group; an aryloxy group; an alkylaryl group; an arylalkyl group; and combinations thereof.

6. The method for preparing a conductive polymer blend composition of claim 5, wherein the polyaniline includes a copolymer polyaniline including o- or m-substituted aniline which contains o-toluidine, m-toluidine, 2-phenoxyaniline, 3-phenoxyaniline, o-ethylaniline, m-ethylaniline, o-ethoxyaniline, m-butylaniline, m-hexylaniline, m-octylaniline, 2,3-dimethylaniline, 2,5-dimethylaniline, 2,5-dimethoxyaniline, o-cyanoaniline, 2,5-dichloroaniline, 2-bromoaniline or 5-chloro-2-methoxyaniline; and 4-phenoxyaniline, 2-aminodiphenyl ether, 1,4-bis(4-aminophenoxy)benzene, 1,3-bis(4-aminophenoxy)benzene, 2,6-dichloronaphthalene, 4-methylcatechol, hydroxyquinone, or a phenol group, in the polymer main chain.

7. The method for preparing a conductive polymer blend composition of claim 1, wherein the conductive polymer is doped or de-doped.

8. The method for preparing a conductive polymer blend composition of claim 1, wherein the polymer-deaggregating agent further includes a member selected from the group consisting of a polar polymer polylactide, a polyvinylalcohol, a polycarprolactone, a polycarbonate, a polymethylmethacrylate, a polyacrylic acid, a polyhydroxybutyrate, a polyethyleneoxide, a polyvinylpyrrolidinone, cellulose derivatives, a thermoplastic starch, a lignin, and combinations thereof.

9. A conductive polymer blend composition, comprising a molecular composite of a conductive polymer and a polymer-deaggregating agent, wherein the polymer-deaggregating agent comprises a polyalkylenecarbonate polymer, a copolymer thereof, or derivatives thereof.

10. The conductive polymer blend composition of claim 9, wherein a weight ratio of the conductive polymer to the polymer-deaggregating agent is from 1:100 to 100:1.

11. The conductive polymer blend composition of claim 9, wherein the conductive polymer includes a member selected from the group consisting of a polyparaphenylene, a polyparaphenylenevinylene, a polyaniline, a polyazine, a polythiophene, a poly-p-phenylene sulfide, a polyfurane, a polypyrrole, a polyselenophene, a polyacetylene, and combinations thereof.

12. The conductive polymer blend composition of claim 9, wherein the conductive polymer is a polyaniline.

13. The conductive polymer blend composition of claim 12, wherein the polyaniline includes a polyaniline substituted and modified by a group selected from the group consisting of an alkyl group; an alkenyl group; an alkoxy group; an alkoxyalkyl group; a thioalkyl group; a cyano group; a halogen group such as fluorine, chlorine, bromine and iodine; an alkoxyaryl group; an alkoxycarbonyl group; an aryl group; an oxyaryl group; an aryloxy group; an alkylaryl group; an arylalkyl group, and combinations thereof.

14. The conductive polymer blend composition of claim 13, wherein the polyaniline includes a copolymer polyaniline including o- or m-substituted aniline which contains o-toluidine, m-toluidine, 2-phenoxyaniline, 3-phenoxyaniline, o-ethylaniline, m-ethylaniline, o-ethoxyaniline, m-butylaniline, m-hexylaniline, m-octylaniline, 2,3-dimethylaniline, 2,5-dimethylaniline, 2,5-dimethoxyaniline, o-cyanoaniline, 2,5-dichloroaniline, 2-bromoaniline or 5-chloro-2-methoxyaniline; and 4-phenoxyaniline, 2-aminodiphenyl ether, 1,4-bis(4-aminophenoxy)benzene, 1,3-bis(4-aminophenoxy)benzene, 2,6-dichloronaphthalene, 4-methylcatechol, hydroxyquinone, or a phenol group, in the polymer main chain.

15. The conductive polymer blend composition of claim 9, wherein the conductive polymer is doped or de-doped.

16. The conductive polymer blend composition of claim 9, wherein the polymer-deaggregating agent further includes a member selected from the group consisting of a polar polymer polylactide, a polyvinylalcohol, a polycarprolactone, a polycarbonate, a polymethylmethacrylate, a polyacrylic acid, a polyhydroxybutyrate, a polyethyleneoxide, a polyvinylpyrrolidinone, cellulose derivatives, a thermoplastic starch, a lignin, and combinations thereof.

17. The method for preparing a conductive polymer blend composition of claim 1, wherein the polymer-deaggregating agent comprises a copolymer having a repeating structure consisting of carbon dioxide and an alkylene oxide.

18. The conductive polymer blend composition of claim 9 wherein the polymer-deaggregating agent comprises a copolymer having a repeating structure consisting of carbon dioxide and an alkylene oxide.

* * * * *